US006253041B1

(12) United States Patent
Tomizawa et al.

(10) Patent No.: US 6,253,041 B1
(45) Date of Patent: Jun. 26, 2001

(54) IMAGE FORMING APPARATUS

(75) Inventors: Takeshi Tomizawa, Numazu; Masahiro Inoue, Mishima; Yuji Bessho, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/449,745

(22) Filed: Nov. 26, 1999

(30) Foreign Application Priority Data

Nov. 27, 1998 (JP) ..... 10-353996
Nov. 27, 1998 (JP) ..... 10-353997
Nov. 27, 1998 (JP) ..... 10-353998

(51) Int. Cl.[7] ..... G03G 15/00; G03G 15/16

(52) U.S. Cl. ..... 399/66; 399/44; 399/45; 399/302

(58) Field of Search ..... 399/45, 44, 50, 399/66, 296, 299, 302, 303, 308, 389, 390; 361/214, 225

(56) References Cited

U.S. PATENT DOCUMENTS 5,019,871 * 5/1991 Takeda et al. ..... 399/66
5,075,731 * 12/1991 Kamimura et al. ..... 399/66
5,091,751 2/1992 Inoue et al. ..... 399/303
5,128,717 * 7/1992 Uchikawa et al. ..... 399/44
5,187,536 2/1993 Hasegawa et al. ..... 399/300
5,276,483 * 1/1994 Hasegawa et al. ..... 399/44
5,455,663 10/1995 Inoue et al. ..... 399/303
5,515,154 5/1996 Hasegawa et al. ..... 399/303
5,563,695 10/1996 Sakurai et al. ..... 399/327
5,594,538 1/1997 Takekoshi et al. ..... 399/310
5,600,421 2/1997 Takekoshi et al. ..... 399/66
5,640,658 6/1997 Inoue et al. ..... 399/298
5,659,842 8/1997 Hasegawa et al. ..... 399/66
5,845,185 * 12/1998 Sakagami et al. ..... 399/302
5,923,938 * 7/1999 Enomoto et al. ..... 399/303
6,029,022 * 2/2000 Takase ..... 399/66

FOREIGN PATENT DOCUMENTS 2-148075 6/1990 (JP) .
5-333713 12/1993 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image forming device for electrostatically forming a toner image onto a transfer material, a charger for previously charging the surface of the transfer material to which the toner image is transferred to a polarity opposite to the normal charge polarity of the toner, and a control device for controlling a voltage to be applied to the charger in accordance with the kind of transfer material.

84 Claims, 12 Drawing Sheets

IMAGE FORMING APPARATUS

BACKGROUND OF THE INVENTION

1. Field of the Invention

The present invention relates to an image forming apparatus such as copying machine, printer, or facsimile using an electrophotographic process.

2. Related Background Art

Hitherto, various image forming apparatuses using the electrophotographic process have been proposed or embodied. For example, there are a system for transferring toner images formed on a photosensitive drum so as to sequentially superpose to a transfer material that is borne and conveyed by a transfer drum or a transfer belt, and a system for primarily transferring toner images formed on the photosensitive drum so as to sequentially superpose to an intermediate transfer belt or an intermediate transfer drum and for secondarily transferring the toner images on the intermediate transfer belt or the intermediate transfer drum to the transfer material. The image forming apparatuses using the two systems will now be described hereinbelow.

The image forming process of the image forming apparatus using the former system (transfer drum) will be simply explained. First, a photosensitive drum is rotated and a charger uniformly charges the surface. Subsequently, a laser beam modulated by an image signal of a first color, for example, magenta of original is irradiated onto the photosensitive drum to form an electrostatic magenta latent image on the photosensitive drum. A magenta developing device develops the electrostatic latent image to form a magenta toner image of the first color on the photosensitive drum.

On the other hand, a transfer material received in a sheet feed cassette is conveyed to a transfer drum by a registration roller or the like. Simultaneously with the conveyance of the transfer material, an adsorption roller is thrust to the surface of the transfer drum and, an adsorption charger adsorbs and charges the transfer material from the rear surface side of the transfer material to electrostatically adsorb the transfer material to the transfer drum. The transfer drum is rotated synchronously with the photosensitive drum. The magenta toner image formed on the photosensitive drum is transferred to the transfer material borne on the transfer drum by a transfer charger. The transfer drum continuously rotates as it is to prepare the next transfer of a cyan toner image of the second color.

The cyan toner image of the second color is formed on the photosensitive drum. The cyan toner image is transferred to the transfer material borne on the transfer drum so as to be superposed onto the magenta toner image. The similar image forming process is repeated with respect to yellow and black of the third and fourth colors, thereby obtaining a fullcolor image formed by superposing the fullcolor toner images of magenta, cyan, yellow, and black on the transfer material.

The transfer material on which the four color toner images have been transferred is separated from the transfer drum and conveyed to a fixing device. The fixing device heats and pressurizes the toner images and transfer material by a fixing roller and a pressure roller to mix the respective colors of the toner images and fix the images to the transfer material, thereby forming a fullcolor print image. The transfer material is discharged out of the apparatus.

An image forming process of the image forming apparatus using the latter system (intermediate transfer drum) will be simply described. A photosensitive drum is rotated at a predetermined peripheral speed. A charger uniformly charges the surface of the photosensitive drum. A laser beam is scanned to expose by an exposing device, an electrostatic latent image of the first color is formed on the photosensitive drum, and the latent image is developed by a developing apparatus. The developing apparatus has four developing devices for a yellow toner, a magenta toner, a cyan toner, and a black toner therein. The developing device for yellow develops the first color electrostatic latent image on the photosensitive drum to visualize as a yellow toner image.

The formed yellow toner image is electrostatically transferred to the intermediate transfer drum in a primary transferring portion where the intermediate transfer drum is come into contact with the photosensitive drum (primary transfer). For the photosensitive drum on which the primary transfer was completed, a cleaner removes the toner remained on the surface and, after that, the drum is used for the next color image formation.

Similarly, the charge by the charger and the exposure of the laser beam are performed to the photosensitive drum to form an electrostatic latent image of the second color. The developing device for magenta develops the latent image on the photosensitive drum to form a magenta toner image on the photosensitive drum. The magenta toner image is transferred to the intermediate transfer drum so as to be superposed to the yellow toner image.

The above process is also repeated with respect to cyan and black to sequentially superpose and transfer the toner images to the intermediate transfer drum. Consequently, a color image obtained by superposing the four color toner images of yellow, magenta, cyan, and black on top of one another is formed on the intermediate transfer drum.

After that, a secondary transfer charger in a separating state is come into contact with the surface of the intermediate transfer drum. In a secondary transferring portion where the intermediate transfer drum is come into contact with the secondary transfer charger, the four color toner images on the intermediate transfer drum are collectively transferred to the surface of the transfer material which is conveyed to the secondary transferring portion at a predetermined timing (secondary transfer).

The transfer material on which the four color toner images have been transferred is conveyed from the intermediate transfer drum to a fixing device, the toner images are fixed by a heat roller or the like to form a fullcolor permanent image, and after that, the transfer material is discharged out of the image forming apparatus.

However, in the image forming apparatus using the former system as mentioned above, since the toner image transfer to the transfer material is repeated, a phenomenon called counter-transfer that the toner image which has already been transferred to the transfer material is offset onto the photosensitive drum at the time of the transfer process for the next color toner image can occur.

For example, in case of forming a blue image, a solid magenta image is first transferred to the transfer material and a solid cyan image is subsequently multi-transferred to it. At the time of the subsequent transfer process, for instance, the transfer processes for yellow and black, no toner to be transferred exists on the corresponding position on the photosensitive drum. In such a state, when the toner image on the surface of the transfer material is close to or come into contact with the surface of the photosensitive drum, such a phenomenon that a part of the toner of the toner image on the transfer material (in this case, it denotes mainly a cyan toner image), namely, cyan toner image is counter-transferred onto the photosensitive drum occurs. Consequently, the density of the cyan toner image deteriorates in the portion where the cyan toner has been counter-transferred, the magenta color of the magenta toner image coated under the cyan toner image appears, and color heterogeneity is generated, so that remarkable deterioration of the image quality is caused.

The phenomenon remarkably occurs when the charge amount of the toner is changed in association with the change in temperature and humidity or the charge amount retainable per unit area of the transfer material is changed in accordance with the kind of transfer material or change in temperature and humidity. Particularly in recent years, as the particle diameter of the toner becomes smaller in order to realize a high picture quality, the charge amount per toner particle 5 is reduced but the total charge amount of the toner image can increase. In association with such a tendency, a transfer current or a transfer voltage necessary to transfer the solid image becomes larger. The increase in transfer current or transfer voltage also exerts an adverse influence to the above-mentioned counter-transfer phenomenon.

In the image forming apparatus using the latter system as mentioned above, in the secondary transfer process, a large amount of toner stacked by an amount corresponding to four colors on the intermediate transfer drum is collectively transferred to the transfer material. At that time, when the absolute value of the charge amount of toner to be transferred is relatively small, the secondary transfer is favorably performed.

However, depending on the ambient atmosphere where the image forming apparatus is used or the kind of transfer material, although it is remarkably recognized particularly in a low humidity environment, there is such a problem that when an enough amount of toner is transferred from the intermediate transfer drum to the transfer material and retained in a state where the absolute value of the toner charge amount is extremely increased, an image failure like a mark due to abnormal discharge occurs. It is thought that the phenomenon is caused because the retainable charge amount per unit area of the transfer material differs depending on the kind of transfer material.

In the case where the charge amount of toner of at least one color among the four color toners used for the image formation is smaller than those of the other colors, in order to uniform the transfer performances of the four color toners, the re-charge is performed to the toner image on the intermediate transfer drum by a corona charger or the like after the primary transfer is completed and before the secondary transfer is started, and the charge amounts of four colors are equalized to uniform the transfer performances in many cases. In this manner, the absolute value of the toner charge amount is larger than that in the preceding state and, in a manner similar to the above, an image failure like a mark due to abnormal discharge occurs at the secondary transferring time.

SUMMARY OF THE INVENTION

It is an object of the present invention to provide an image forming apparatus which can prevent an image failure from occurring due to electric discharge or the like when a toner image is formed to a transfer material by image forming means.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

The invention will now be described hereinbelow with reference to the drawings.

Embodiment 1

Figure 1:
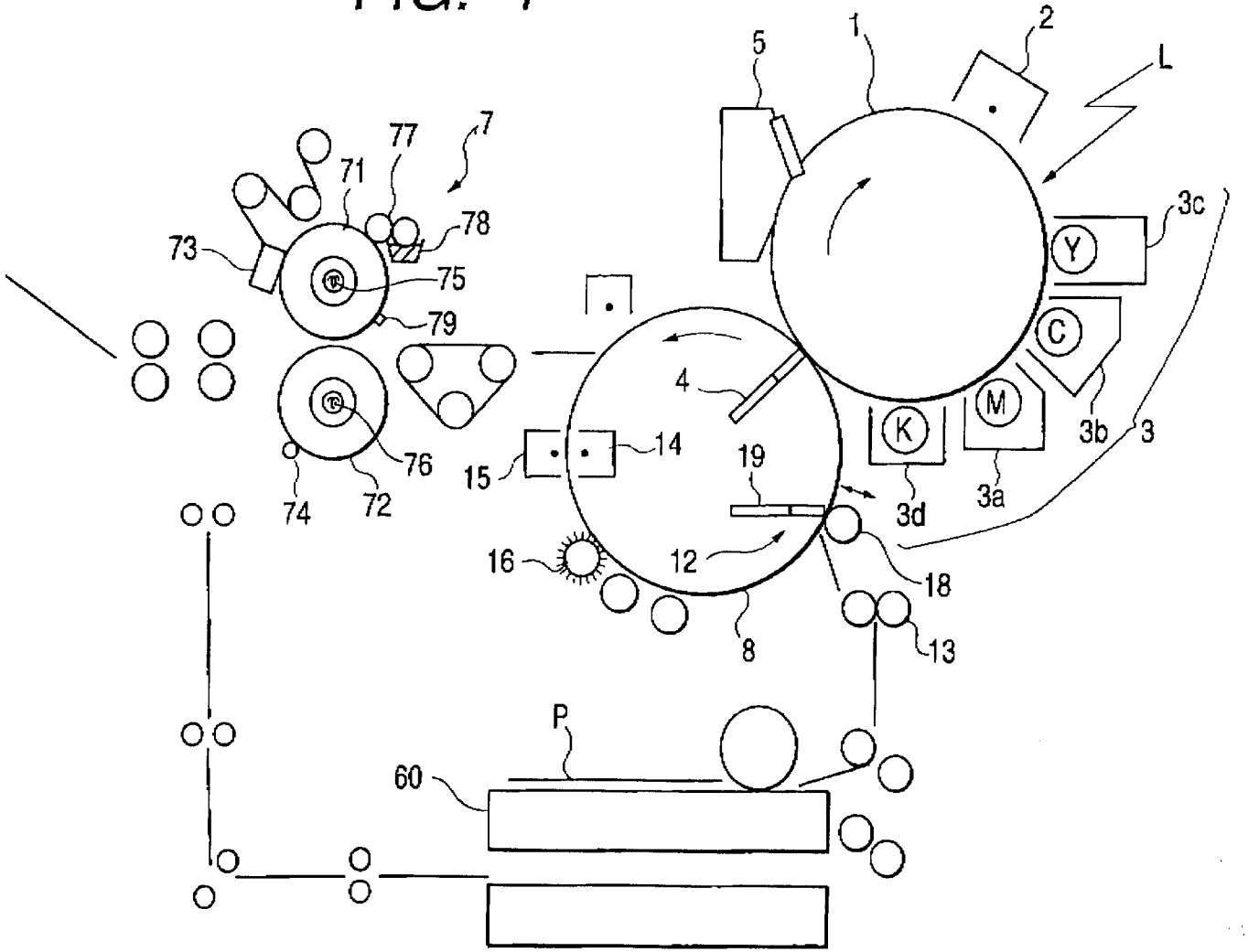
FIG. 1 is a schematic constructional diagram showing an image forming apparatus to which the present invention can be applied.

FIG. 1 shows a color copying machine as an image forming apparatus.

In an image forming portion of the present color copying machine, a photosensitive drum 1 is arranged as an image bearing member. A primary charger 2, light equipment (not shown), a polygon mirror (not shown) for scanning light L from the light equipment, and an electro static voltmeter (not shown) for detecting the surface potential of the photosensitive drum 1 are arranged around the photosensitive drum 1.

Light corresponding to an image signal of each color component is emitted from the light equipment. The light is scanned by rotating the polygon mirror, a luminous flux of the scanned light is deflected by a reflecting mirror, it is converged onto the generatrix of the photosensitive drum 1 through an fθ lens, so that an electrostatic latent image of each color component corresponding to the image signal is sequentially formed on the photosensitive drum 1.

Four developing devices 3, namely, a magenta developing device 3*a*, a cyan developing device 3*b*, a yellow developing device 3*c*, and a black developing device 3*d* are arranged adjacent to the photosensitive drum 1. They are filled with developer of magenta, cyan, yellow, and black of predetermined amounts by feeders, respectively. The developing devices 3 are detachably arranged on the positions facing the outer peripheral surface of the photosensitive drum 1 to develop the electrostatic latent images formed on the photosensitive drum 1.

A transfer drum 8 as a transfer material bearing member is placed obliquely under the photosensitive drum 1. A transfer material P from a transfer material cassette 60 set below the main body of the apparatus is conveyed to the transfer drum B through registration rollers 13 and the like. The transfer drum 8 is formed into a drum-shape by joining a resin film made of polyethylene terephthalate, polyvinylidene fluoride, polycarbonate, or polyurethane so as to fit to a frame formed by coupling two rings by a coupling member The whole operation of the color image forming apparatus will now be simply described with respect to an example of an image formation of four colors. First, the photosensitive drum 1 is rotated and the charger 2 uniformly charges the surface of the photosensitive drum 1. Subsequently, a laser beam modulated by an image signal of the first color, for example, magenta of original (not shown) is irradiated onto the photosensitive drum 1 to form an electrostatic latent image for magenta onto the photosensitive drum 1. The latent image is developed by the magenta developing device 3*a* previously fixed onto a developing position, thereby forming a toner image of magenta of the first color onto the photosensitive drum 1.

On the other hand, the transfer material P from the cassette 60 is pressed out by the registration rollers 13 and the like in the direction along the transfer drum 8. Simultaneously with the pressing-out of the transfer material P, an adsorption roller 18 of contact type adsorption charge means 12 is thrust to the surface of the transfer drum 8. The transfer material P is adsorbed and charged from the rear surface side by an adsorption charger (brush) 19, to which an adsorption power supply (constant current power supply) has been connected, of the adsorption charge means 12, so that the transfer material P is electrostatically borne on the transfer drum 8. The transfer drum 8 rotates synchronously with the photosensitive drum 1 in the direction shown by an arrow in the diagram. The magenta toner image formed on the photosensitive drum 1 is transferred to the transfer material P by contact type transfer charge means 4. The transfer drum 8 continuously rotates as it is to prepare the transfer of a cyan toner image of the second color.

When the transfer of the magenta toner image is finished, a cleaning member 5 cleans the transfer residual toner on the photosensitive drum 1. After that, similarly, the charge by the charger 2, the irradiation of the laser beam, and subsequent processes are performed to form the cyan toner image of the second color on the photosensitive drum 1. The cyan toner image is transferred to the transfer material P so as to be superposed onto the magenta toner image. The similar image forming process is performed with respect to yellow and black as third and fourth colors, thereby obtaining a color image formed by superposing and transferring the four color toner images of magenta, cyan, yellow, and black on the transfer material P.

The transfer material P to which the four color toner images have been transferred is separated from the transfer drum 8 by the operation of a separation pawl and is sent to a fixing device 7 by a conveying belt or the like.

The fixing device 7 comprises: a fixing roller 71; a pressure roller 72; heat-resistant cleaning members 73, 74 for the above rollers; heaters 75, 76 enclosed in the fixing roller 71 and the pressure roller 72, respectively; a coating roller 77 for coating molding lubricant oil such as dimethyl silicone oil onto the fixing roller 71; an oil pool 78 for supplying the molding lubricant oil; and a thermistor 79 for a fixing temperature control. The fixing device 7 heats and pressurizes the conveyed transfer material P by the fixing roller 71 and the pressure roller 72 to mix the respective colors of the toner images and fix the images onto the transfer material P, thereby forming a fullcolor print image.

The residual toner on the transfer drum 8 is scraped off by a rotating fur brush 16 after the residual charge is eliminated by residual charge eliminators 14 and 15 to remove an electrostatic adsorptive force. As removing means for the residual toner, in addition to the above, a blade or bonded-fiber fabric is solely used or they are used together.

As mentioned above, in the image forming apparatus as shown in FIG. 1, since the color image is formed by multi-transfer to repeat the transfer so as to superpose toner images onto the transfer material P, there is a case where a phenomenon called counter-transfer that the already transferred toner image is again transferred to the photosensitive drum 1 at the time of the next transfer process is caused. Consequently, the color of a toner layer located under the portion in which the density is deteriorated due to the counter-transfer of the toner layer on the surface appears, so that remarkable deterioration of the picture quality is caused.

The present inventors have repeatedly researched and examined the above counter-transfer and could solve that the counter-transfer occurs in accordance with a mechanism, which will be described hereinbelow.

As for a transfer material (paper) that is used in the above-mentioned image forming apparatus, the state is remarkably changed owing to a temperature and humidity during the storage time. Due to the examination by the present inventors, it has become clear that electrical characteristics of paper just after the opening of a package was extremely different from that of paper whose moisture was conditioned in a low-humidity environment (for example, 23° C., 5% RH) after the opening and was remarkably reduced. That is, it has become clear that when the water content contained in the paper was reduced, there was a limit in charge amount retainable in the front and rear surfaces.

Figure 2:
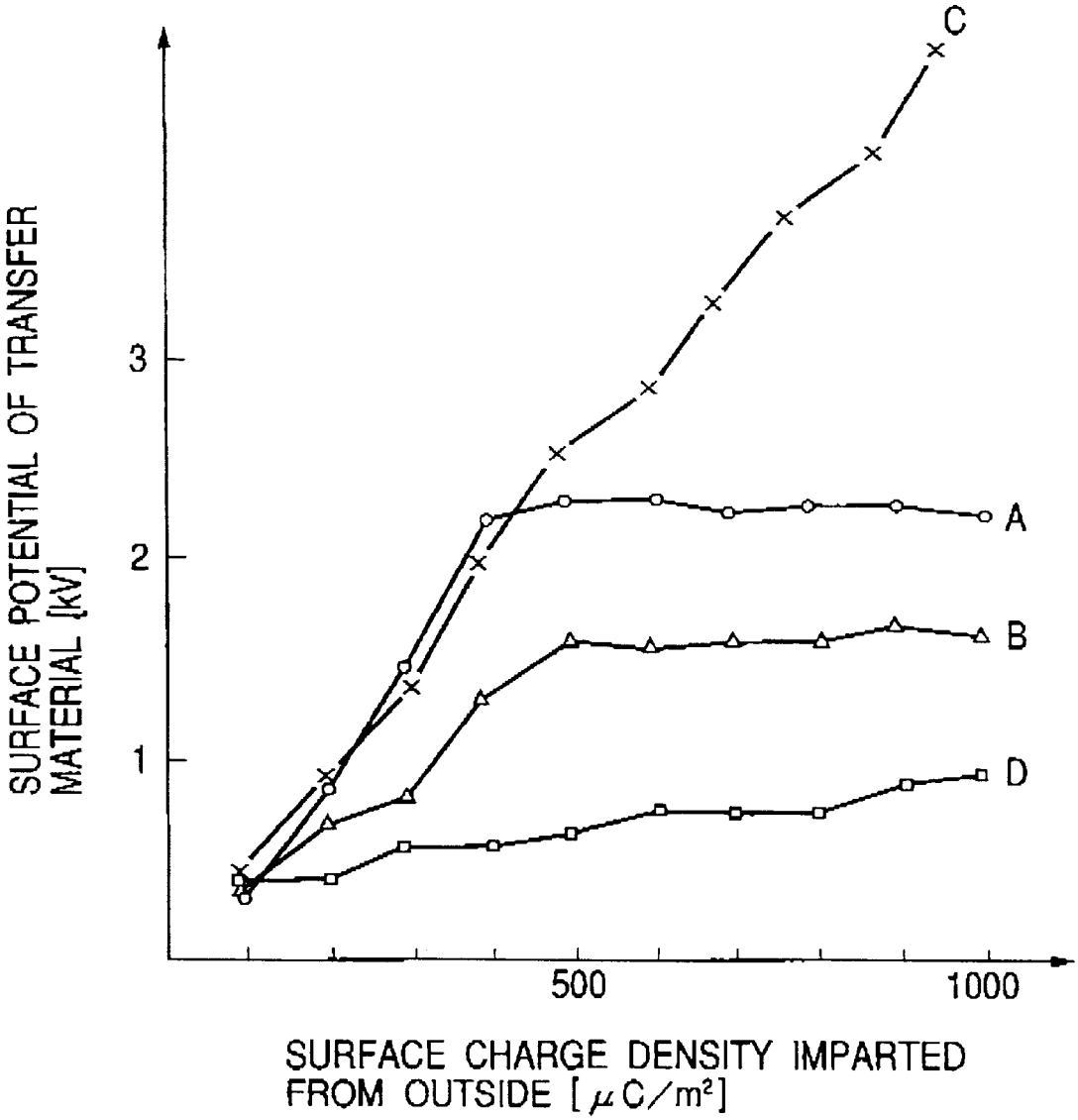
FIG. 2 is a graph showing a relation between a charge amount per unit area supplied to the rear surface of a transfer material and a potential of a front surface of the transfer material at that time.

FIG. 2 is a correlation diagram of the surface charge density imparted from the outside to the surface of the transfer material and the potential of the transfer material surface. In FIG. 2, a graph C denotes the result when OHT (made of a PET sheet, the thickness is equal to 100 $\mu$m) is used as a transfer material. For the OHT, the surface potential linearly rises in proportion to the supplied charge amount and it performs its duties as an ideal capacitor. A graph D indicates the result when a sheet of paper just after the opening is used. Although the inclination is low as compared to the supplied charge amount, the surface potential linearly rises in a manner similar to the graph C and is ideal.

On the other hand, a graph A denotes the result obtained when a sheet of NPI fine paper (basic weight: 128 g/m$^2$, thickness: 120 $\mu$m) of Haga Foreign Paper Shop was passed once through a fixing device in order to imitate the moisture conditioning in a low humidity environment and then used. A graph B indicates the result obtained when a sheet of both-side thick paper for CLC (basic weight: 105 g/m$^2$, thickness: 100 $\mu$m) made by Canon was similarly passed once through the fixing device and then used. In case of them, the paper of the graph A loses the linearity near 450 $\mu$C/m$^2$ and the paper of the graph B loses the linearity near 500 $\mu$C/m$^2$, respectively. It has such a tendency that is not seen in the above NPI fine paper (graph D) just after the opening or OHT (graph C).

It is thought as follows. In the case where the moisture in the paper is conditioned in a low humidity environment and is reduced, when a charge of a certain value or more is supplied to the surface of the paper, electric discharge occurs in fine gaps between fibers in the paper and the charge on the front and rear surfaces of the paper is balanced. Therefore, even when the charge is supplied any more, the charge cannot be accumulated on the front and rear surfaces of the paper, so that the surface potential is not raised.

In the above image forming apparatus as well, in the case where an image is formed on such a sheet of paper in which the moisture is conditioned in a low humidity environment, when the charge of a certain amount or more is supplied while the transfer process is performed, the retainable charge amount of the paper reaches the limit, electric discharge in the paper is started, the paper sharply loses the retaining force for toner, so that such an image failure that dotted blank portions occur in the image is generated.

Referring to FIG. 2, the maximum charge amount retainable by a paper moisture-conditioned in the low humidity environment (23° C., 5% RH) is equal to about 500 $\mu$C/m$^2$.

In this instance, in the image forming apparatus, when it is assumed that the maximum toner bearing amount per unit area is set to 1 mg/cm$^2$ per color and the charge amount per toner unit weight is set to 30 $\mu$C/g, a toner charge of 300 $\mu$C/m$^2$ is imparted to the paper each time the transfer process is completed once. Consequently, how many color toners can be transferred to the sheets of paper shown In the graphs A and B in FIG. 2 is as follows.

$$300\times\chi\leqq 500 \therefore \chi\leqq 1.67$$

It will be understood that only about 1.67 color toners can be transferred at maximum.

Generally, in the color image forming apparatus, from such reasons that it is difficult to reproduce black using three colors of cyan, magenta, and yellow and it is desired to economize in toner amount, UCR (Under Color Removal) has been used. Specifically speaking, according to the UCR, the shared portion (black component) of cyan, magenta, and yellow is replaced to black and the replacing amounts are subtracted from the total amounts of cyan, magenta, and yellow. The improvement of a black reproducibility can be performed and the toner amount can also be remarkably cut down by the UCR.

Although it is different depending on the kind of apparatus, ordinarily, the image formation is performed by using the toner amount of two colors at the maximum total amount. In the embodiment, the UCR is applied and the maximum transfer toner total amount is set to the amount of two colors. However, it exceeds the above-mentioned amount of 1.67 colors. When the transfer is performed onto a sheet of paper in which the water content is remarkably low, the above-mentioned dotted transfer failure occurs. That is, when the transfer of four colors is normally performed, it is necessary that the maximum retainable charge amount exceeds (300×2=) 600 $\mu$C/m$^2$ at least. When the transfer is performed onto a sheet of paper having a remarkably low water content, the dotted transfer failure occurs.

According to the examination of the present inventors, the following became clear. That is, in the case where the transfer is performed onto a transfer material in which the water content is remarkably reduced, for example, paper whose moisture is conditioned in a low humidity environment or paper which was passed once through the fixing device, the transfer material is previously charged to a polarity opposite to that in the transfer before the transfer and the maximum retainable charge amount of the transfer material is relatively increased, so that the occurrence of the above dotted transfer failure can be prevented and a good image can be obtained.

Figure 3:
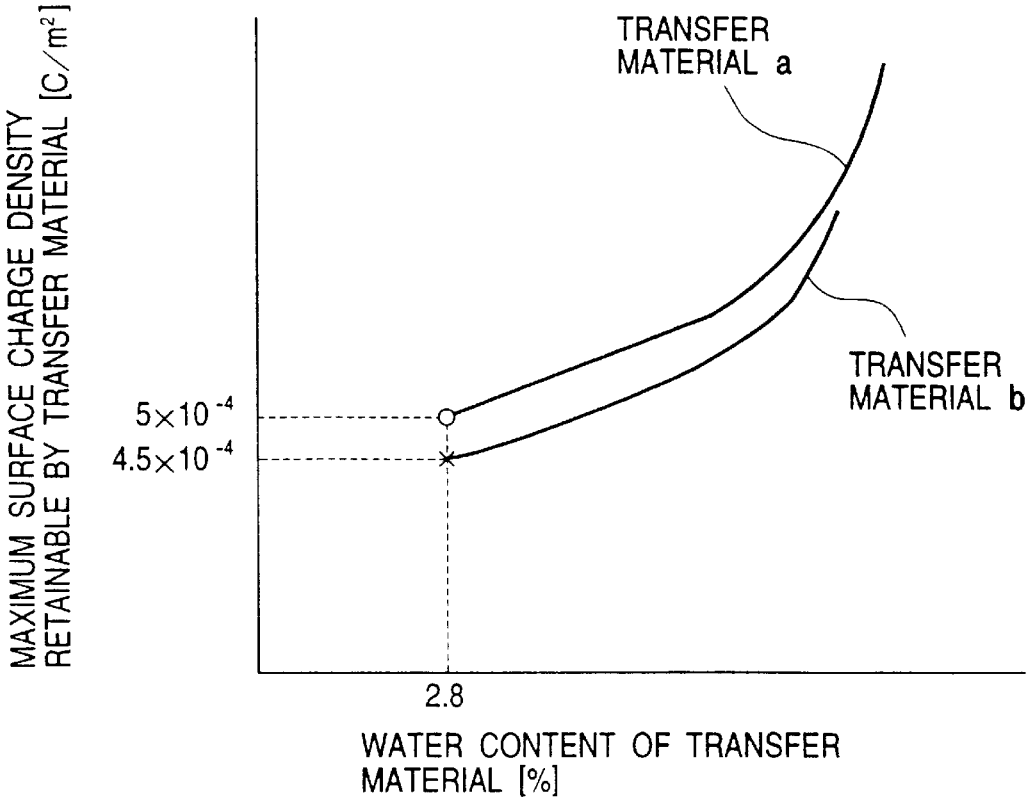
FIG. 3 is a graph showing a relation between the water content of a transfer material and the maximum surface charge density which is retainable by the transfer material.

That Is, it turns out that the environment and the kind of transfer material determine the charge amount per unit area retainable by the transfer material. FIG. 3 shows a relation between the water content and the retainable charge amount (surface charge density) per unit area with respect to transfer materials a and b.

When the above result is applied to the counter-transfer phenomenon, explanation can be made as follows.

In the present embodiment, when the charge amount of a developed toner adhered on the photosensitive drum 1 in the development is measured, it is equal to −30 $\mu$C/g in the above low humidity environment and the toner bearing amount per unit area of the solid image in case of monochrome is equal to 1.0 mg/cm$^2$. Therefore, the total toner charge amount per unit area is equal to −300 $\mu$C/m$^2$. Actually, it is not a monochromatic image but the four color toners are multi-transferred to form a fullcolor image in many cases. In that case, the maximum toner bearing amount per unit area on the transfer material is further increased. In this case, the toner bearing amount on the transfer material is determined due to, for example, fixing conditions or the like in many cases.

According to the present embodiment, the toner bearing amount per unit area which can be fixed at a fixing temperature of 150° C. is set to a bearing amount that is 2.0 times as much as the maximum bearing amount in case of the monochromatic. The fullcolor image is formed at such a bearing amount. Therefore, since the maximum toner bearing amount per unit area is set to 2.0 mg/cm$^2$, the toner having the total charge amount of −600 $\mu$C/m$^2$ forms an image on the transfer material.

From the above, in the normal setting, the charge amount corresponding to the maximum toner bearing amount on the transfer material exceeds the maximum charge amount per unit area retainable on the transfer material, the transfer material cannot retain all of the toners having the charge, so that the toners on the transfer material causes the counter-transfer that toners are transferred from the transfer material to the photosensitive drum in a transfer nip.

When the above contents are generalized and expressed by an expression, it is as follows. When it is assumed that the maximum toner charge amount per unit area of the developed toner adhered on the photosensitive drum is set to Qt=Qt(k)(C/m$^2$), the toner bearing amount is set to M(kg/m$^2$), and the charge amount per unit area retainable on the surface of the transfer material is set to Qp=Qp(s, k)(C/m$^2$), $$Qp(s, k)/Qt(k)\geqq M$$

(wherein k: ambient factor such as temperature, humidity, or absolute water content, s; a kind of transfer material.) The toner image transferred on the transfer material is not retained on the transfer material at an amount that satisfies the above expression and exceeds the toner bearing amount M, so that the counter-transfer occurs. Therefore, depending on the maximum retainable charge density of the transfer material, the maximum toner bearing amount per unit area has to be reduced. That is, the density is forced to decrease.

According to the present embodiment, prior to a transfer process, a charge having a polarity opposite to that of a charge to be supplied to the rear surface of the transfer material in the transfer process is previously supplied to the transfer material in an adsorbing process, thereby increasing an apparent maximum charge amount per unit area retainable on the transfer material.

That is, the surface of the transfer material to which the toner image is transferred is charged to a polarity opposite to a normal toner charge polarity in the adsorbing process.

In the adsorbing process, a voltage having the same polarity as that of the normal toner charge polarity is applied to the adsorption brush 19 by the adsorption power supply. The adsorption roller 18 thrusts the transfer material to the transfer drum 8 and is also electrically connected to the ground. The adsorption charge means 12 is not limited to the above construction. So long as it has a construction to charge the surface of the transfer material to the polarity opposite to the normal toner charge polarity, the means can have the other construction.

In the transferring process, a voltage having a polarity opposite to the normal charge polarity of the toner is applied to the transfer charger 4.

Namely, when it is assumed that the charge density per unit area to be previously supplied to the rear surface of the transfer material is set to Qa(s, k)($C/m^2$)(Qa denotes the same symbol as Qp), the toner up to the toner bearing amount to satisfy the following expression can be transferred.

$$\{Qp(s, k)+Qa(s, k)\}/Qt(k) \geqq M$$

The problem can be solved without substantially reducing the toner bearing amount.

Since the maximum retainable charge density of the transfer material is set to Qp(s, k)($C/m^2$), the charge can merely be supplied up to Qa to satisfy the following expression.

$$|Qa(s, k)| \leqq |Qp(s, k)|$$

Therefore, the maximum value of |Qa(s, k)| is obtained when the following expression is satisfied.

$$|Qa(s, k)| = |Qp(s, k)|$$

(wherein, Qa and Qp have the same polarity.) Therefore, $$M \leqq 2Qp/Qt.$$

Even in case of a bearing amount that is twice as much as the conventional maximum toner bearing amount, the problem of the counter-transfer is not caused.

How to control will now be specifically described hereinbelow.

First, the environment and the kind of transfer material are set. For the environment, an automatic detection setting system by a sensor for detecting relative humidity or relative humidity and temperature can be used or the user of the copying machine can also input it by himself. Similarly, with respect to the kind of transfer material as well, the automatic detection setting system can be applied or the copying user can also input. They can also be used together.

When the environment and the kind of transfer material are determined, Qt and Qp for them are decided. Therefore, Qa is also decided. According to the present embodiment, since Qa is supplied in the adsorbing process to adsorb the transfer material to the transfer sheet of the transfer drum 8, an adsorption current value (adsorption voltage to be applied to the adsorption brush in the case when the adsorption power supply is a constant voltage power supply) is decided. There is a correlation between the adsorptive force and the adsorption current value. The current value to assure the enough adsorptive force is determined.

Therefore, according to the present embodiment, Oa in the case where the adsorptive force is maximized under the following conditions is set.

$$|Qt \cdot M - Qp| \leqq |Qa| \leqq |Qp|$$

When a specific numerical value is mentioned, in case of the transfer material B, since Qp(s, k)=$-1500\times10^{-6}C/m^2$, Qa(s, k)=$-500\times10^{-6}C/m^2$ or Qt(k)=$-30\times10^{-3}C/kg$ and M=20 $kg/m^2$. Consequently, the following relation is sufficiently satisfied.

$$\{Qp(s, k)+Qa(s, k)\}/Qt(k) \geqq M$$

In the present embodiment, as means for supplying the charge having a polarity opposite to that of a charge to be supplied to the transfer material at the transferring time to the transfer material before the transferring process of the first color, the adsorption charge means 12 for adsorbing the transfer material onto the transfer sheet of the transfer drum 8 is used. In this case, there is a fear that the charge to adsorb the transfer material to the transfer sheet is lost at the transferring time and the transfer material is separated from the transfer sheet. According to the present embodiment, the feared matter is avoided by taking the following step.

That is, when the transfer charge is supplied to the transfer material by the transfer charge means 4 in the transferring process, the supply is not performed until a leading end of the transfer material enters the transfer nip and the supply of the transfer charge is started after the transfer material enters the transfer nip to reach a desired transfer supply charge density in a non-image area in the leading end of the transfer material. For a trailing end of the transfer material as well, the transfer supply charge density is immediately decreased after an image area in the trailing end of the transfer material passes through the transfer nip.

In this manner, the adsorption charge between the transfer material and the transfer sheet supplied in the adsorbing process is maintained in the leading and trailing ends of the transfer material during the image formation. It is maintained until separating means separates the transfer material from the transfer sheet. That is, the above fear that the transfer material is separated from the transfer sheet is avoided.

In this instance, it is more effective that the charge amount to be supplied in the adsorbing portion is changed depending on the kind of the transfer material. For example, in case of the transfer materials a and b, this is because since the maximum retainable charge density of the transfer material a is different from that of the transfer material b, the maximum charge density to be supplied in the adsorbing portion before the transfer process of the first color is also different. In case of the transfer material a, different from that of the transfer material b, the maximum retainable charge amount of the transfer material is smaller, so that the charge amount density retainable by the opposite polarity is small. When a charge amount larger than the maximum charge amount density is supplied to the transfer material, abnormal electric discharge occurs in the adsorbing process and it results in the cause of the image failure. Therefore, according to the present embodiment, in case of the transfer material a, the material is adsorbed at an adsorption current of −27 μA that is smaller than the adsorption current value of −30 μA of the transfer material b.

According to the present embodiment, with respect to the kind of transfer material whose basis weight exceeds 105 $g/m^2$, there is a process of performing the adsorption twice in order to stabilize the conveying performance of the transfer material.

The transfer material enters between the adsorption brush 19 as adsorption charge means 12 to which the adsorption power supply has been connected and the adsorption roller 18 connected to the ground, the adsorption charge means 12 charges the transfer material to the polarity opposite to that at the transferring time by supplying the current having a polarity and a direction which are opposite to those at the transferring time through the transfer sheet of the transfer drum 8 and also allows the transfer material to be electrostatically adsorbed to the transfer sheet. However, only In the adsorbing process of one time, during the procedure to repeat the multi-transfer of four colors, depending on the kind of transfer material, the rigidity of the transfer material can cause inconvenience that, for example, the leading end or trailing end of the transfer material is lifted from the transfer sheet and it is come into contact with members arranged on the outside of the transfer drum to cause the image failure or the transfer material is separated from the transfer sheet.

According to the present embodiment, the transfer charge means 4 is used as second adsorption charge means, after the transfer material is adsorbed to the transfer sheet by the adsorption charge means 12, the transfer drum 8 is idly rotated through one revolution with no transfer process, a current having the same polarity (same direction) as that at the adsorbing time (current having a polarity (direction) opposite to that of the transfer current at the transferring time) is applied to the transfer charge means 4 in the transferring portion, and the transfer material is again adsorbed to the transfer sheet, thereby raising the adsorptive force.

In this case, a high-voltage power supply of the transfer charge means 4 need to have performance to supply two polarity currents of positive and negative. Therefore, the costs of the power supply increase. In order to solve an increase in cost, the adsorbing process of the second time is performed by the adsorption charge means 12, so that no adsorption and no charge to the same polarity by the transfer charge means 4 can be performed.

Figure 4:
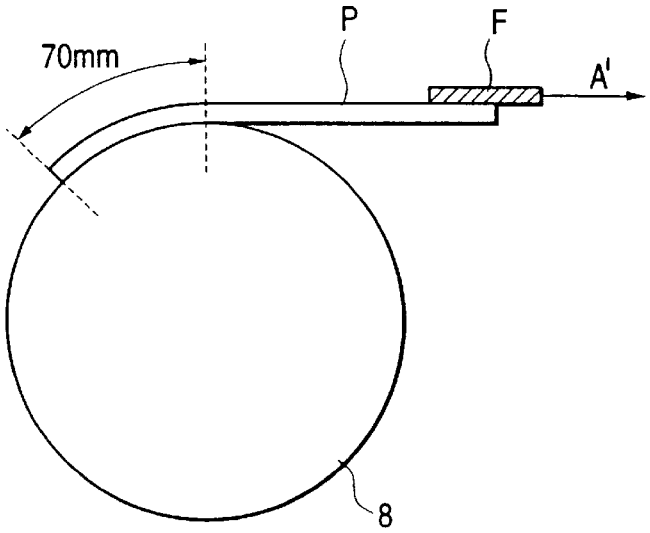
FIG. 4 is an explanatory diagram showing a measuring method of the adsorptive force of a transfer material in the present invention.

A measuring method of the adsorptive force of the transfer material according to the present invention will now be explained with reference to FIG. 4. The copying operation is started, the transfer material P is adsorbed to the transfer drum 8 by the adsorbing unit, the adsorption of the whole of the transfer material P to the transfer drum 8 is completed, and in this state, the copying operation is stopped. For the size of the transfer material P, although both of the A4 size and the A3 size can be used, the length in the thrust direction (longitudinal direction of the transfer drum 8) is set to 297 mm. The portion from the end to 70 mm of the transfer material P is held to be adsorbed to the transfer drum 8, the remaining portion is separated from the transfer drum 8, the end of a force gauge (Hand-Held DIGITAL FORCE GAUGE made by SHIMPO) F is adhered to the end of the separated portion of the transfer material P by tape. The transfer material P adsorbed to the transfer drum 8 so as to remain the portion of 70 mm from the end is pulled by the gauge F in the tangential direction A' of the transfer drum 8. A force when the transfer material P is separated from the transfer drum 8 is set to the adsorptive force. In this instance, the transfer drum is set so that it cannot rotate.

When the resistance value of the transfer sheet is relatively low, most of the current supplied to the adsorption brush does not flow into the transfer material but it flows into a non sheet passing portion (outsides of the both ends of the transfer material) of the transfer material in the direction perpendicular to the conveying direction of the transfer material Therefore, in this case, it is preferable to vary the current amount flowing from the adsorption brush to the adsorption roller in accordance with the longitudinal (thrust width) length of the transfer material.

According to the present embodiment, from an adsorption current amount I1 that is needed when the length of a certain transfer material is A4R (thrust length: 210 mm) and an adsorption current amount I2 that is required when the length of the same kind of transfer material is A4 (297 mm), an adsorption current amount I(x) for x mm as a length in the thrust direction of the same kind of transfer material is determined in accordance with the following equation.

$$I(x)=(I2-I1)(x-210)/87\times I1$$

In this manner, even when the width of the transfer material differs, the current amount flowing per unit area of the transfer material can be close to a predetermined value. It is more effective.

Embodiment 2

According to the present embodiment, the registration rollers 13 to control the paper feed timing of the transfer material is used as charge means for the transfer material P and a charge having a polarity opposite to that of a charge supplied in the transfer process is supplied to the transfer material by the registration rollers 13.

Therefore, in the case where the image forming apparatus includes no adsorbing process as well, before the transfer material enters the transfer process of the first color, the transfer material can be charged to the polarity opposite to that at the transferring time, so that the effect similar to the embodiment 1 can be obtained. Similar to the embodiment 1, it is preferable to change the current value depending on the kind of transfer material.

As mentioned above, as charge means in the present invention, any member which can supply a charge to the front surface or rear surface of the transfer material before the transfer process of the first color can be used. For example, a curling roller for curling the transfer material to assist in the adsorption to the transfer material or a pickup roller for picking up the transfer material in the cassette to a transfer material conveying path can also charge the transfer material, so that the similar effects can be obtained.

Further, the transfer material feeding unit can also be used as charge means. In the case where the transfer material is borne on the transfer sheet by a gripper, even when the transfer drum is rotated through one revolution in a state where the transfer material is borne on the transfer sheet before the transferring process of the first color and the charge having the polarity opposite to that of the supplied charge to the transfer material at the transferring time is supplied to the transfer material by the inside and outside residual charge eliminators 14 and 15 or a separation charger, the similar effects can be obtained. In this case, the similar process can be performed in the transferring portion.

Embodiment 3

The fundamental construction of the present embodiment 3 is similar to those of the embodiments 1 and 2. According to the aspect of the present embodiment, the state of the transfer material is monitored and the charge amount to be supplied to the transfer material before the transfer process of the first color is changed in accordance with the state.

Figure 5A:
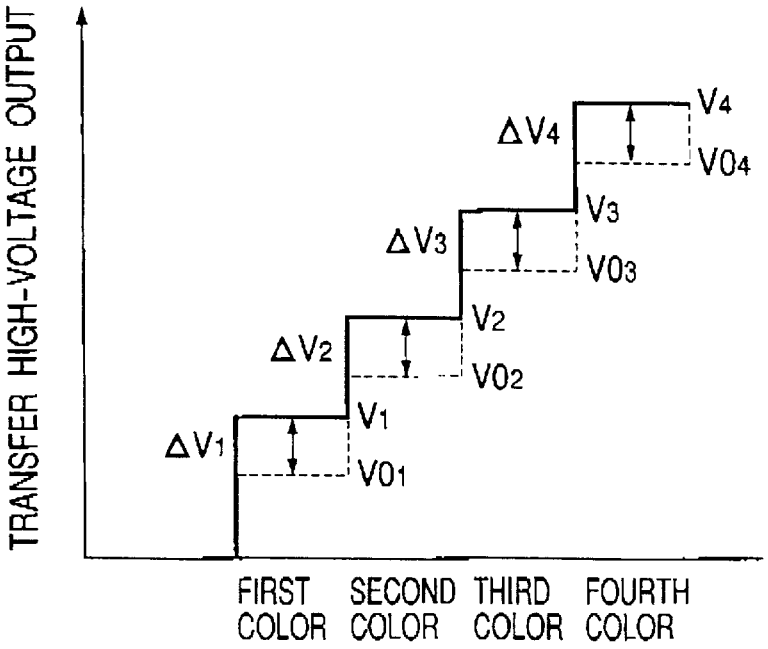
FIGS. 5A and 5B are potential graphs schematically showing a normal increase and an abnormal increase in transfer potential by multi-transfer.
Figure 5B:
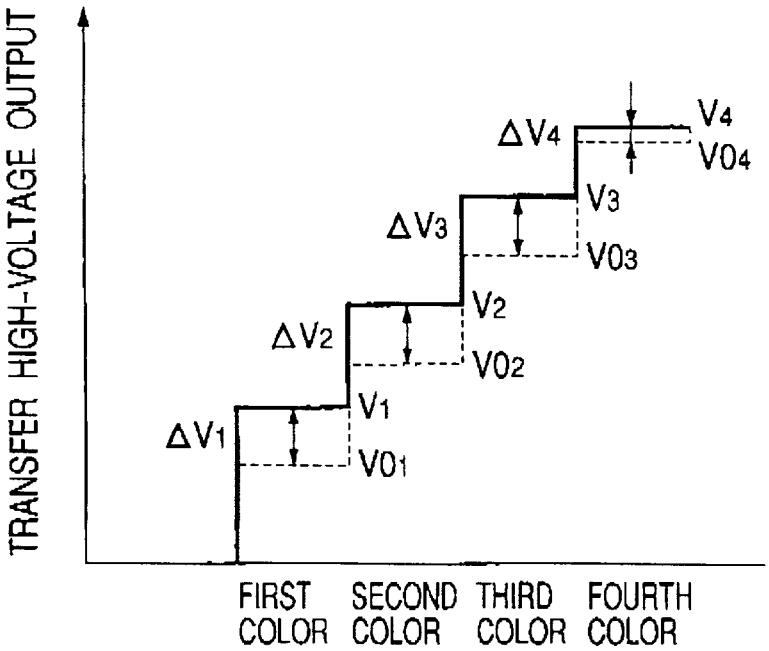

In the present embodiment, since the constant current power supply is used as a power supply for transfer, a transfer voltage to the constant current control is monitored during the image formation. It is assumed that the voltage is set to Vi (where, i denotes a color order). In this instance, the transfer voltage to the transfer current in the case where no transfer material exists in each environment is previously measured and stored into a storage medium. It is assumed that the voltage is set to VOi. In FIGS. 5A and 5B, the transfer voltage VOi is shown by a broken line.

During the image formation, a difference ΔVi=Vi −VOi between the monitored transfer voltage and the transfer voltage recorded in the storage medium is monitored. ΔVi is ordinarily held constant for a certain transfer current. However, in the case where the charge amount supplied to the transfer material exceeds the charge amount retainable by the transfer material, when a certain color is transferred, ΔVi decreases. For example, there is such a phenomenon that although ΔVi is held constant for a period of time from the first color to the third color, in case of the fourth color as a final color, it is substantially equal to 0 as shown in FIG. 5B.

Therefore, according to the present embodiment, in order to always keep ΔVi constant, the charge amount to be supplied in the adsorbing portion is set in accordance with the change in ΔVi. Consequently, the charge amount supplied to the transfer material is set to the charge amount retainable by the transfer material. For the transfer potential after such a countermeasure, ΔVi can be held constant for a period of time from the first color to the fourth color as shown in FIG. 5A.

For instance, when the transfer material A is allowed to pass in the low humidity ambient atmosphere (temperature: 23° C., humidity: 5%), a potential of the first transfer material in the case where it is transferred at a standard set transfer current of 24 μA is monitored, the potential lies within a range from 540V to 570V for a period of time from ΔV1 to ΔV3. However, in case only of ΔV4, it is equal to 180V. Since ΔV4 is deviated from ΔV1 by 20% or more, measures are taken from the following calculation (in the present embodiment, although the deviation amount from the value of ΔV1 is set to 20%, the error range can have the other value).

Since it is enough that ΔVi is equal to or larger than 570V, the charge amount corresponding to ΔVi is calculated. The charge amount of the polarity opposite to that of the charge amount corresponding to this value may be supplied to the transfer material in the adsorbing portion.

For example, the calculation can be made as follows. As for a charge amount ΔQ in which a transfer current value I(A) is supplied for a unit time (one second), ΔQ=I×1(C). When it is assumed that an electrostatic capacity of the transfer material is set to Cp, a rising voltage ΔV of a partial voltage of the transfer material to the charge amount is as follows.

$$\Delta Q = Cp \times \Delta V$$

The charge amount ΔQ to be supplied to the transfer material per unit time is obtained from the transfer current value flowed at the first color. The electrostatic capacity Cp of the transfer material is obtained from ΔV of the first color. When CP is used and it is assumed that the difference between ΔV4 of the fourth color and ΔV1 of the first color is set to ΔVd4 (=ΔV1−ΔV4), since it is necessary to charge the transfer material to the opposite polarity by a charge amount corresponding to the voltage difference or more, ΔQa of the opposite charge amount −ΔQa is obtained by the following equation.

$$\Delta Qa = Cp \times \Delta Vd4$$

In the case where ΔVi is equal to about 570V at the above transfer current of 24 μA, $$2.4 \times 10^{-5} = Cp \times 570.$$

Consequently, $$Cp = 4.2 \times 10^{-8}$$

Since the decrease amount of ΔV4 of the fourth color from ΔV1 of the first color is equal to (570−180=) 390V, $$\Delta Qa = 4.2 \times 10^{-8} \times 390 = 1.6 \times 10^{-5}.$$

Therefore, as for the current which flows in the adsorbing portion, the current value which has a polarity opposite to that at the transferring time and which is equal to −16 μA or less, namely, the current value having an absolute value that is equal to or larger than 16 μA can be supplied. When the absolute value of the calculated ΔQa is small, the adsorptive force can be deteriorated. Therefore, when it becomes smaller than the absolute value of a certain set value (−15 μA in the present embodiment), the absolute value of such a value is set not to be smaller than the set value.

Similarly, when the voltage in case of ΔV3 is already smaller than that of ΔV1, it is necessary to reversely charge the transfer material in the adsorbing process at a charge amount corresponding to the sum of the charge amount of (Cp×ΔVd3) to equalize ΔV3 to ΔV1 and the charge amount of (Cp×ΔVd4) to equalize ΔV4 to ΔV1. When the voltage in case of ΔV2 is already smaller than ΔV1, it is necessary to reversely charge at a charge amount corresponding to the sum of (Cp×ΔVd2), (Qp×ΔVd3), and (Cp×ΔVd4).

In the above-mentioned manner, irrespective of the kind of the transfer material, the minimum required absorption current can be automatically obtained. The above means is one means for automatically detecting the impedance of the transfer material and any other means can also be used. For example, a transfer high-voltage output is controlled to a constant voltage and the current at that time can be monitored (in this case, a set value which has previously been recorded in the storage medium is also a current value) or the water content of the transfer material is detected by an infrared water content meter and the impedance of the transfer material can also be automatically detected from a relation between the absolute water content and the impedance of the transfer material.

Figure 6:
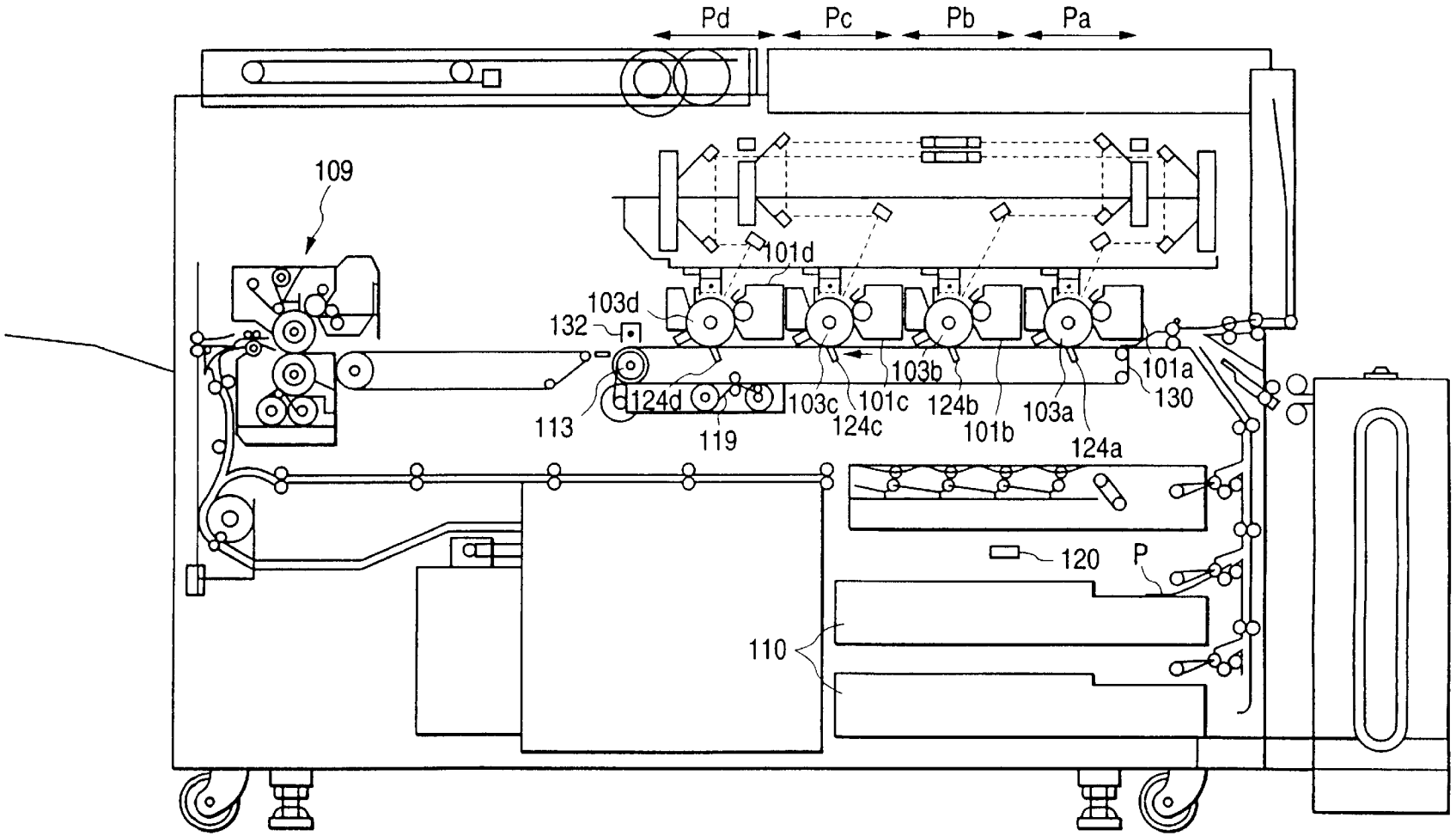
FIG. 6 is a schematic constructional diagram showing an embodiment of an image forming apparatus of the present invention.

In the above embodiments, the present invention has been described with respect to the image forming apparatus for forming an image by one photosensitive drum and one transfer drum shown in FIG. 1 as an example. As will be described in detail hereinbelow, however, it is a matter of course that the present invention can also be applied to a tandem image forming apparatus having four photosensitive drums as shown in FIG. 6. Although the case of using the toner whose normal charge polarity is negative has been shown, a toner having a positive polarity can also be used.

In this case, a positive charge can be supplied to the rear surface of the transfer material before the transfer process of the first color, so that the effects of the present invention can be similarly obtained.

All of the above embodiments have been described with respect to the image forming apparatus for multi-transferring the toner images of a plurality of colors onto the transfer material. In case of a monochromatic image formation as well, it is a matter of course that the charging the transfer material to the polarity opposite to that at the transferring time is effective in preventing the transfer-failed image.

For instance, in a black-and-white image forming apparatus, when the charge density of the toner borne per unit area increases, the transfer material is previously charged to a polarity opposite to that at the transferring time from the above reason, so that an apparent charge amount density retainable by the transfer material can be raised, thereby preventing the transfer failure of a toner corresponding to a charge amount which cannot be retained by the transfer material.

As described in the above embodiments, the means for charging the transfer material to the polarity opposite to that at the transferring time can also be arranged in the preceding step before the transfer means such as pickup roller, curling roller, or registration roller, or a reverse charging member can also be separately arranged.

Embodiment 4

The present invention can also be applied to an image forming apparatus as shown in FIG. 6, which has a plurality of image forming portions, forms toner images of different colors in the image forming portions, and sequentially superposes and transfers the toner images onto the same transfer material to form a color image on the transfer material.

As shown in FIG. 6, in the apparatus, first, second, third, and fourth image forming portions Pa, Pb, Pc, and Pd are arranged. In the image forming portions Pa to Pd, different color toner images are formed through latent image forming, developing, and transferring processes.

The image forming portions Pa, Pb, Pc, and Pd have dedicated image bearing members, namely, electrophotographic photosensitive drums 103*a*, 103*b*, 103*c*, and 103*d*, respectively, in the present embodiment. The respective color toner images are formed on the photosensitive drums 103*a*, 103*b*, 103*c*, and 103*d*, respectively. A transfer belt 130 as a transfer material bearing member is placed adjacent to the photosensitive drums 103*a*, 103*b*, 103*c*, and 103*d*. The respective color toner images formed on the photosensitive drums 103*a*, 103*b*, 103*c*, and 103*d* are superposed and transferred onto the transfer material P which is borne on the transfer belt 103 and conveyed, by transfer chargers 124*a* to 124*d*.

For the transfer material P on which the respective color toner images have been transferred, the toner images are fixed by heating and pressurizing by a fixing device 109 and, after that, the transfer material holding a color recording image is discharged out of the apparatus.

In the present invention, as a dielectric sheet material of the transfer belt 130 in FIG. 6, a film-shaped sheet made of engineering plastic such as PET, polyacetal, polyamide, polyvinyl alcohol, polyether ketone, polystyrene, polybutylene terephthalate, polymethylpentene, polypropylene, polyethylene, polyphenylene sulfide, polyurethane, silicone resin, polyamide-imide, polycarbonate, polyphenylene oxide, polyether sulfone, polysulfone, aromatic polyester, polyether-imide, or aromatic polyimide is generally used.

According to the present embodiment, as a material of the transfer belt 130, a polyimide resin is used from the viewpoints of mechanical characteristics, electrical characteristics, and incombustibility. The volume resistivity is equal to $10^{16}$ Ωcm, thickness is equal to 100 μm, and it is a seamless type.

Driving means for driving the transfer belt and detecting means for detecting the width of the transfer material are provided and the processing speed is equal to 100 mm/sec.

The contact type transfer charger 124 (124*a* to 124*d*) has a transfer member made of plate-shaped dielectric rubber extending in the direction (thrust direction) perpendicular to the transfer material conveying direction. The transfer member is thrust so as to come into contact with the photosensitive drum 103 (103*a* to 103*d*) through the transfer belt 130. The transfer charger 124 charges the transfer material P conveyed to the transferring portion to a polarity (positive in the present embodiment) opposite to that of a toner from the rear surface side. The toner image on the photosensitive drum 103 is electrostatically transferred to the front surface of the transfer material P. In the present embodiment, the transfer charger 124 is controlled to a constant current and the transfer current is set to 10 μA.

A separation charger 132 is arranged above the most downstream portion of the transfer belt 130, namely, above a driving roller 113 of the transfer belt 130 and has a discharge wire. The discharge wire is stretched in the thrust direction. The tension is kept by arranging a spring on the one end of the discharge wire. The feed to the discharge wire is performed through a feeder terminal, a feeder pin, and the spring (they are not shown) from a connector on the apparatus main body side.

The driving roller 113 is connected to the earth of the main body and also serves as a function of a counter electrode of the discharge wire. According to the present embodiment, a distance between the transfer charger 124*d* of the final-stage image forming portion Pd and the separation charging portion 132 is equal to 50 mm and an AC of 10 kVpp is supplied to the separation charger 132.

In the present embodiment as well, similar to the embodiments 1 to 3, the counter-transfer phenomenon and dotted transfer blank phenomenon can be prevented.

Figure 7:
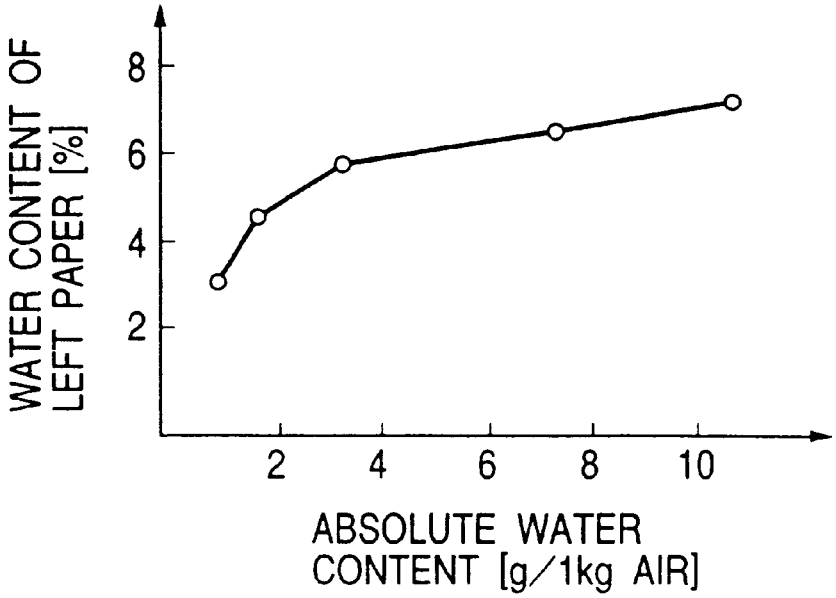
FIG. 7 is a graph showing a relation between the absolute water content of an ambient atmosphere and the water content of a transfer material.

FIG. 7 shows a relation between the absolute water content of the environment where the paper is left and the water content of the paper. From this, it is understood that as the absolute water content of the environment where the paper is left becomes smaller, the water content of the paper is also decreased.

Therefore, a hygrothermosensor 120 which can measure a temperature and humidity is arranged in the image forming apparatus main body, and near a transfer material storage cassette 110 as close as possible. From the temperature and humidity in the apparatus detected by the hygrothermosensor 120, the absolute water content in the apparatus is derived and the water content of the paper is obtained on the basis of it from FIG. 7. Further, the maximum surface charge amount retainable by the paper is obtained from FIG. 3 and the reverse charge amount to be supplied to the transfer material before the transfer is obtained from the above equations.

Figure 8:
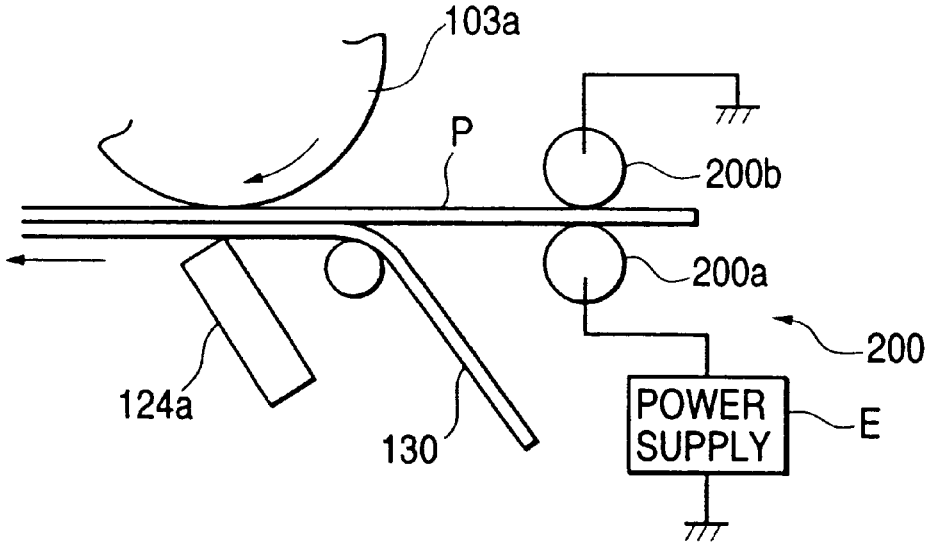
FIG. 8 is an explanatory diagram showing reverse charge before transfer in the embodiment of the present invention.

FIG. 8 shows an example when the reverse charge before the transfer is embodied. In front of the transferring portion constructed by the photosensitive drum 103*a* of the first image forming portion Pa and the transfer belt 130, reverse charge means 200 comprising dielectric rollers 200*a* and 200*b* is placed. One of them, for example, the lower roller

200*a* is used as an apply roller. A high-voltage power supply E that is controlled to a constant current is connected to this roller. The other upper roller 200*b* is set to a counter roller and is connected to the ground. The transfer material P before entering the transferring portion is sandwiched by the rollers 200*a* and 200*b*, a bias voltage is applied to the roller 200*a* from the power supply E to supply a current to the roller 200*b* by the constant current control, so that the charge of the polarity opposite to that at the transferring time is supplied to the rear surface of the transfer material P and the transfer material P is reversely charged prior to the transfer.

When the constant current control is performed, even in the case where the kind of paper or thickness of the transfer material is changed or the resistance in the vertical direction on the surface of the transfer material gradually changes, It is possible to cope with the case with no problem and there is such an advantage that the constant reserve charge can be supplied to the transfer material P. In the present embodiment, in order to set Qa to be equal to, for example, 100 $\mu C/m^2$, the reverse charge current of 3 $\mu A$ can be allowed to flow from the roller 200*a* to one 200*b*.

Figure 9A:
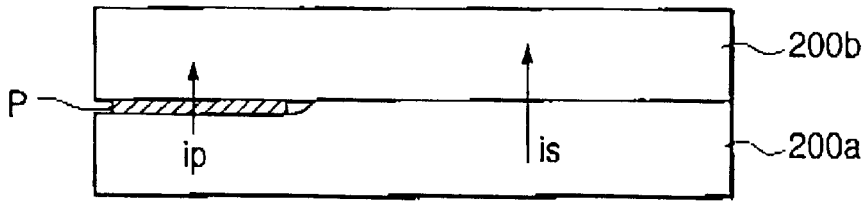
FIGS. 9A and 9B are explanatory diagrams each showing the situation of a current which flows between rollers of reverse charge means for reversely charging when a small-sized sheet of paper is passed through between the rollers.
Figure 9B:
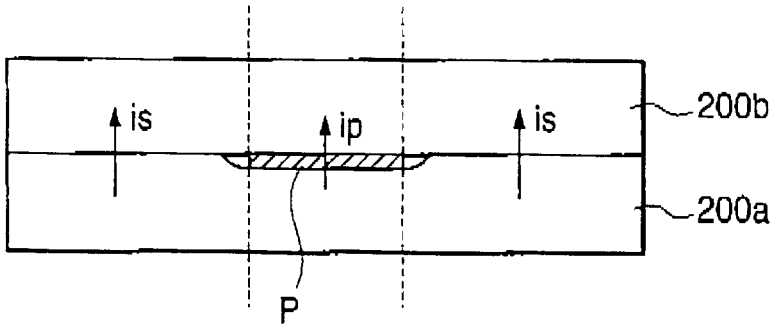

However, generally in this kind of apparatus, the transfer material with a small size that is equal to or smaller than the usable maximum recording width (thrust direction) can also be used. Therefore, in the case where the small-sized paper is passed through, as shown in FIGS. 9A and 9B, with respect to the current which flows between the rollers 200*a* and 200*b*, the current "is" in a non sheet passing portion becomes remarkably larger than a current "ip" in a sheet passing portion, so that the necessary reverse charge cannot be performed to the transfer material P. For example, when a postcard having a width of 100 mm is passed through, the resistance ratio of the sheet passing portion to the non sheet passing portion is set to 10:1. Most of the current flowing between the rollers 200*a* and 200*b* flows through the non sheet passing portion and the reverse charge of a desired amount cannot be supplied to the paper, so that the dotted transfer blank occurs at the transferring time.

According to the present embodiment, the reverse charge current value is changed in accordance with the width of the transfer material to be passed, so that the failure of the reverse charge before the transfer is prevented even in case of the small-sized transfer material, thereby preventing the dotted transfer blank. It will be described in detail hereinbelow.

Table 1 is a result obtained by examining a relation between the width [w] of the transfer material to be passed and the resistance ratio u of the sheet passing portion to the non sheet passing portion.

TABLE 1

| Width of Transfer Material (mm) | Resistance Ratio u Of Sheet Passing Portion To Non Sheet Passing Portion |
|---|---|
| 148 | 2.8 |
| 185 | 2.0 |
| 210 | 1.4 |
| 257 | 0.6 |
| 297 | 0.3 |

When it is assumed that the reverse charge amount is set to Qa($C/m^2$) and the processing speed is set to v (m/sec), the reverse charge total amount of the transfer material per second is expressed as follows.

$$Qa \cdot w \cdot v (C)$$

In this instance, a current Ir which flows between the rollers 200*a* and 200*b* is expressed as follows from the resistance ratio u of Table 1.

$$Ir = Qa \cdot w \cdot v \cdot (u+1)$$

Consequently, the desired reverse charge is performed even to the small-sized transfer material.

Figure 10:
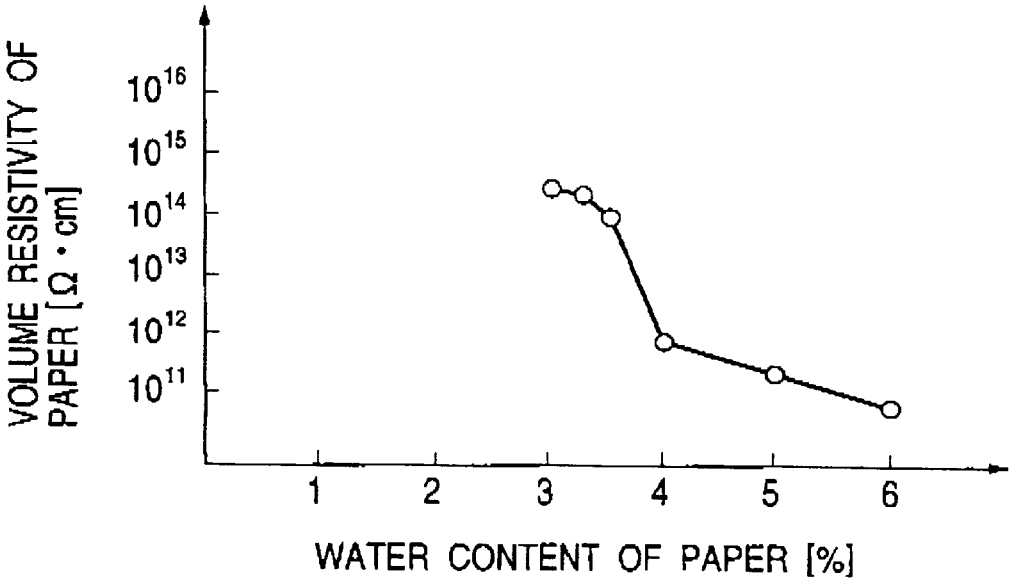
FIG. 10 is a graph showing a relation between the water content and the volume resistivity of paper.

Table 1 shows one example. It is preferable to store a plurality of tables in the apparatus in accordance with the volume resistivity and thickness of the transfer material. Since the water content of the transfer material can be obtained from the set environment of the apparatus from FIG. 7, the volume resistivity of the paper is derived from the relation between the water content and the volume resistivity of the paper as shown in FIG. 10. The width of paper is detected in a manual paper feeding unit or a cassette paper feeding unit. The necessary table with respect to the resistance ratio u of the sheet passing portion to the non sheet passing portion is read from those numerical values. Ir can be determined in accordance with the resistance ratio.

According to a further preferred embodiment of the present embodiment, the relations as shown in FIGS. 3 and 7 and Table 1 have been stored in the apparatus main body by the number corresponding to the kinds of transfer materials, when the image forming apparatus is used, the user previously inputs the kind of transfer material to the apparatus main body, and the retainable maximum surface charge density of each transfer material previously stored in the apparatus main body is obtained from the transfer material information, so that it is clear that the further preferred result is obtained.

According to the present embodiment, as shown in FIG. 9A, the case where the transfer material P is conveyed on the end of the conveying belt 130 in the conveying direction is assumed. As shown in FIG. 9B; the case where the transfer material P is always controlled so as to position on the center in the thrust direction and is conveyed can also be assumed.

For the detection of the sheet width w of the transfer material P, in addition to the automatic discrimination using a mechanical sensor or an optical sensor, the operator can also input the sheet width from a console unit or the like instead of the detection. As for the detection of the thickness of transfer material, any detecting means can be set in the apparatus or the operator can also input the thickness of transfer material from the outside of the apparatus.

Although the transfer belt has been shown as a transfer material bearing member in the above, the transfer drum can also be used. The image bearing member is not limited to an electrophotographic photosensitive member such as a photosensitive drum but a dielectric member in an electrostatic recording can also be used.

For the developing device 101 (101*a* to 101*d*), any developing method can be applied.

Generally, the developing method is mainly divided to mono-component development and two-component development. The mono-component development includes: mono-component non contact development to coat a toner onto a developing sleeve by a blade or the like in case of a non-magnetic toner or, in case of a magnetic toner, coat the toner onto the developing sleeve due to a magnetic attraction, convey it to a developing portion opposite to the image bearing member by the rotation of the developing sleeve, and to develop the toner in a non-contact state with the image bearing member; and mono-component contact development to perform the above former processes and develop the toner in a contact state with the image bearing member. The two-component development uses a two-component developer made by mixing toner particles and magnetic carriers and includes: two-component non-contact development to coat the developer onto the developing sleeve due to the magnetic attraction, convey it to the developing portion by the developing sleeve, and develop the developer in a non-contact state with the image bearing member; and two-component contact development to perform the above former processes and develop the developer in a contact state with the image bearing member. From the viewpoints of the realization of a high picture quality or high stability, the two-component contact development is used in many cases.

Although the present embodiment has shown the case of the color printer or copying machine, it can also be applied to a black-and-white printer or copying machine. It can also be applied to both of a digital type and an analog type.

The present embodiment has been constructed as mentioned above. As shown in FIG. 8, the rollers 200*a* and 200*b* are arranged as reverse charge means in front of the transferring portion, the transfer material P is sandwiched by the rollers 200*a* and 200*b* before it enters the transferring portion, and the transfer material is charged to a polarity opposite to that at the transferring time. At the reverse charging time, the reverse charge amount Qr ($C/m^2$), processing speed v (m/sec), resistance ratio u of the sheet passing portion to the non sheet passing portion, and reverse charge current Ir flowing between the rollers 200*a* and 200*b* are defined as follows.

$$Ir=Qr\cdot w\cdot v\cdot(u+1)$$

Consequently, the transfer material P can be reversely charged neither too much nor too less before the transfer irrespective of the sheet width, so that the occurrence of the dotted transfer blank can be prevented even in the case of the small-sized transfer material.

Embodiment 5

In the embodiment 4, the reverse charge current is controlled in accordance with the sheet width of the transfer material P so that the reverse charge can be performed neither too much nor too less even in case of the small-sized transfer material. However, for example, in case of passing a sheet of paper in which the sheet width is small and the resistance is high, the reverse charge current amount remarkably increases and the voltage of the high-voltage power supply E also extremely increases in association with the increase, so that a load on the power supply excessively increase. In order to store the sheet width, kind of paper, leaving conditions, and resistance ratio of the sheet passing portion to the non sheet passing portion into the apparatus, a memory having a relatively large capacity is needed, so that the cost of the apparatus is increased.

According to the present embodiment, the reverse charge width before the transfer can be changed in accordance with the width of the transfer material to be passed, so that it is possible that the current necessary to obtain a desired reverse charge amount is minimized, a surplus current is not needed even in case of a transfer material having a small width and a high resistance, the storage of the resistance ratio of the sheet passing portion to the non sheet passing portion into the apparatus is not also needed, and the necessary capacity of the memory is also reduced.

Figure 11:
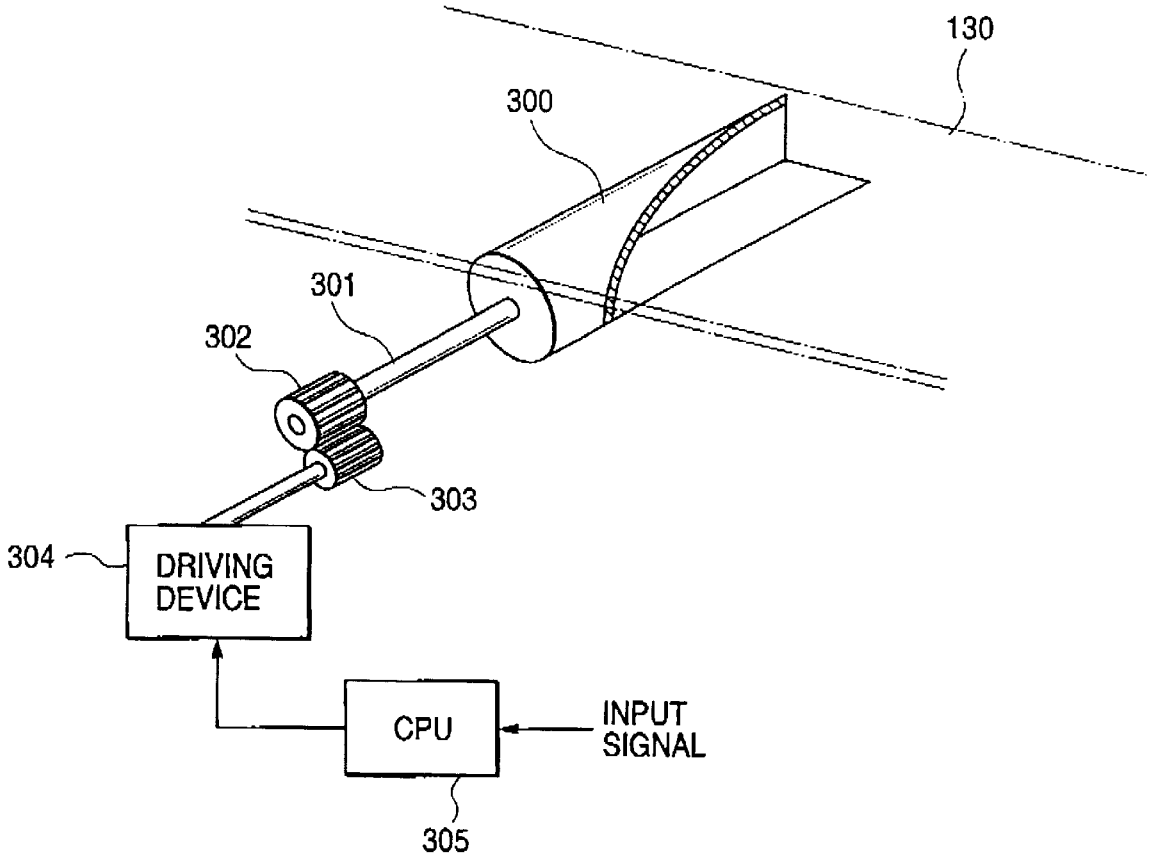
FIG. 11 is a perspective view showing a lower roller of the reverse charge means used in another embodiment of the present invention and its rotational control system.

According to the present embodiment, a roller 300 as shown in FIG. 11 is used instead of the roller 200*a* shown in the lower portion of FIG. 8. The present roller 300 is constructed in such a manner that a dielectric cylinder member is cut so that a cut-away amount is increased in the thrust direction in order to successively change the length in the thrust direction of the roller 300 in the circumferential direction.

The roller 300 can be rotated in the circumferential direction by pivotably engaging a center axis 301 thereof with an attaching portion (not shown). The roller is rotated by a forward and reverse rotating motor of a driving device 304 through a gear 302 attached to the end of the center axis 301 and a gear 303 on the driving device 304 side, which engages with the gear 302. A CPU 305 controls the rotating amount.

In the manual sheet feed portion or cassette sheet feed portion, the sheet width of the transfer material P is always detected. The sheet width information is sent to the CPU 305. The CPU 305 controls the rotation angle of the motor of the driving device 304 in accordance with the sheet width information. The motor of the driving device 304 is rotated, thereby rotating the roller 300 only by a predetermined angle. The circumferential surface of the roller 300 having a length corresponding to the sheet width of the transfer material P is allowed to face the transfer belt 130.

Consequently, for the current necessary for the reverse charge before the transfer, with respect to the sheet width w, reverse charge amount Qa, and processing speed v, it is performed by the current value Ir expressed by the following equation.

$$Ir=Qa\cdot w\cdot v$$

The maximum retainable charge amount can be obtained according to the embodiment 1.

Although the roller 300 is controlled so that the thrust length is substantially equal to the width of the transfer material P to be passed by rotating by the driving device 304, it is not necessary to equalize them and the thrust length can be set to be slightly longer.

In the present embodiment, although the roller 300 is set to the lower roller of the rollers for reverse charge, it can also be set to the upper roller.

As mentioned above, according to the present embodiment, since the roller in which the reverse charge region can be changed is used, even in case of passing the small-sized transfer material, the current amount Ir for reverse charge before the transfer or the capacity of the memory in the image forming apparatus used can be suppressed.

Although the above embodiments 4 and 5 have described the image forming apparatus for multi-transferring toner images of a plurality of colors to the transfer material, it is a matter of course that in case of a monochromatic image formation as well, the charging the transfer material to a polarity opposite to that at the transferring time is effective to prevent the transfer failure.

For example, in a black-and-white image forming apparatus, when the charge density of the toner borne per unit area increases, the transfer material is previously charged to a polarity opposite to that at the transferring time for the above reasons, so that the apparent retainable charge density of the transfer material can be raised to prevent the transfer failure of toner corresponding to the charge amount which cannot be retained by the transfer material.

The means for charging the transfer material to the polarity opposite to that at the transferring time can be assembled in the step before the transfer means such as pickup roller for picking up the transfer material from the storage cassette for the transfer material, curling means, or registration roller and the reverse charge member can also be independently arranged.

Embodiment 6

The present invention can also be applied to an image forming apparatus having an intermediate transfer member, which will be explained with reference to FIG. 12, in a manner similar to the above embodiments.

Figure 12:
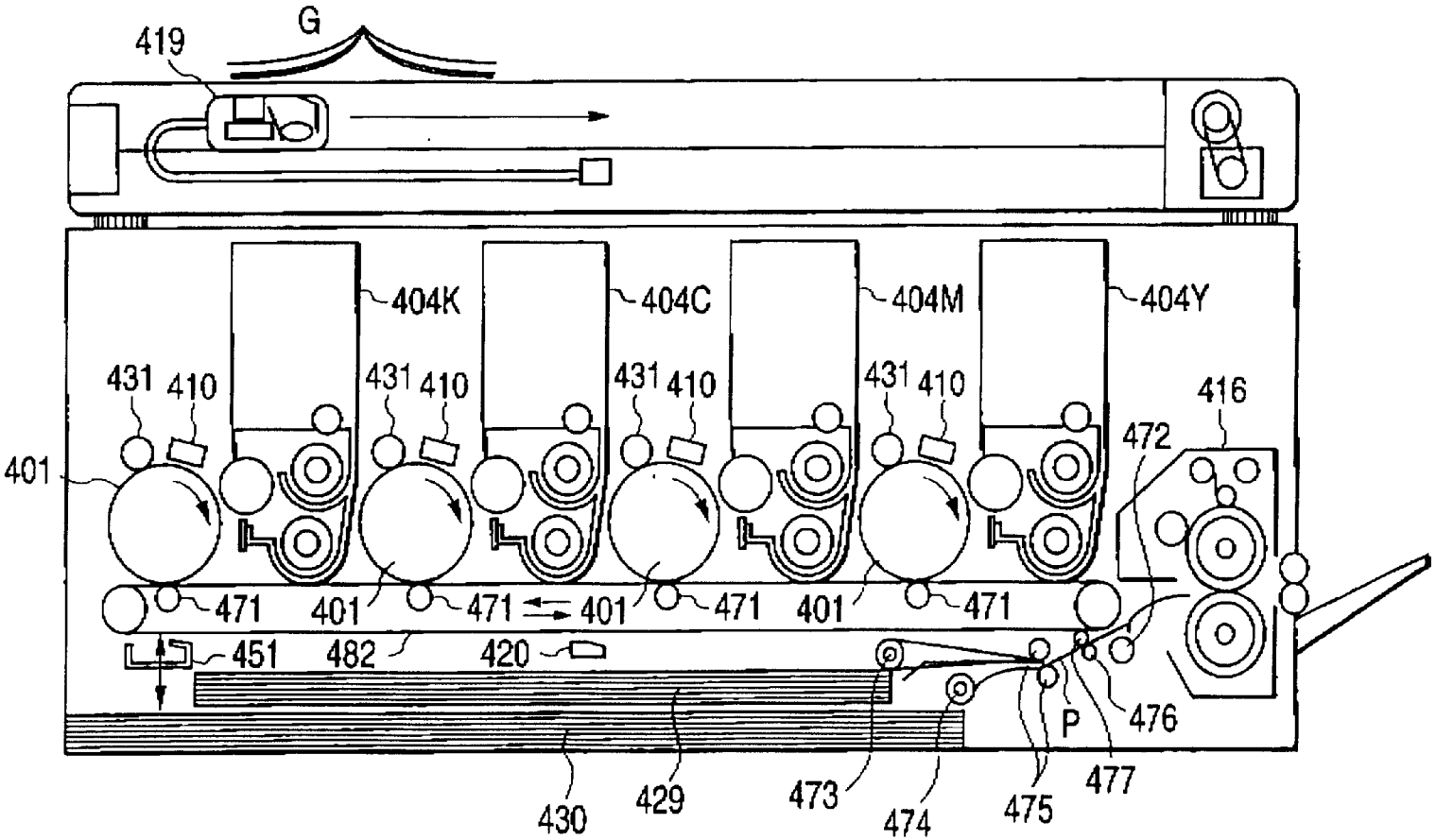
FIG. 12 is a schematic constructional diagram showing an embodiment of the image forming apparatus of the present invention.

FIG. 12 is a schematic constructional diagram showing one embodiment of the image forming apparatus of the present invention. The present apparatus is a color image forming apparatus of the electrophotographic system, has four image forming units of yellow, magenta, cyan, and black, and outputs a fullcolor Image.

The present image forming apparatus applies the two-component contact development as a developing method and uses the developer made by mixing toners formed by a polymerizing method into the magnetic carriers as two-component developer. A developing device of each image forming unit also functions as a cleaner and a cleaner for a photosensitive drum is omitted.

Toner images formed by the image forming units are multi-transferred to an intermediate transfer belt 482 by primary transfer means and, after that, they are collectively transferred onto the transfer material by secondary transfer means, thereby forming a fullcolor image.

The image forming process will now be first described. First, original C is set on an original stocking plate so that the surface to be copied is set downward. Subsequently, depressing a copy button starts the copy. A scanner unit 419 reads an original image. Read red, green, and blue color image information is color-separated to yellow, magenta, cyan, and black. The colors are converted into respective signals and sent to a printer portion.

In the printer portion, the image forming units for yellow, magenta, cyan, and black are placed. Each of the image forming units has: a photosensitive drum 401 serving as an image bearing member; a charge roller 431 for uniformly charging the photosensitive drum 401; an LED solid scanner 410 as an image exposing system for forming an electrostatic latent image onto the charged photosensitive drum 401; developing device 404Y, 404M, 404C, or 404K for developing the formed electrostatic latent image by the toner; and a transfer roller 471 as primary transfer means for electrostatically transferring the obtained toner image to the intermediate transfer belt 482.

When the image signal of yellow is sent to the printer portion, in the yellow image forming unit, a photosignal corresponding to the yellow image signal is irradiated by the scanner 410 onto the photosensitive drum 401 previously charged by the charge roller 431, thereby forming the electrostatic latent image on the photosensitive drum 401. The electrostatic latent image is developed by the developing device 404Y receiving a yellow toner to form a yellow toner image on the photosensitive drum 1. The yellow toner image is transferred onto the intermediate transfer belt 482 by the transfer roller 471 as primary transfer means.

Simultaneously with the operation, in the magenta image forming unit, a photosignal corresponding to the magenta image signal is irradiated onto the photosensitive drum 401, thereby forming an electrostatic latent image onto the photosensitive drum 401. The electrostatic latent image is developed by the developing device 404M receiving a magenta toner to form a magenta toner image on the photosensitive drum 401. The magenta toner image formed in this manner is superposed and transferred to the intermediate transfer belt 482 on which the yellow toner image has already been formed. Further, the similar process is performed with respect to cyan and black, thereby forming a fullcolor image onto the intermediate transfer belt 482.

The fullcolor image obtained by the above processes on the intermediate transfer belt 482 is secondarily transferred by a transfer roller 472, to which the voltage is applied, onto the transfer material P conveyed from a transfer material storage cassette 429 or 430 and supplied to a secondary transferring portion in which the transfer roller 472 is set. The transfer material P is picked up from the cassette 429 or 430 by a pickup roller 473 or 474 and supplied to the secondary transferring portion by a pair of registration rollers 475, 475 synchronously with the fullcolor image on the intermediate transfer belt 482.

According to the present invention, at that time, the transfer material P from the pair of registration rollers 475, 475 is supplied to the secondary transferring portion through a reverse charge roller 476 and a counter roller 477. It will be described hereinlater.

The transfer material P on which the fullcolor image has been transferred is conveyed to a fixing device 416 to be thermally fixed. In this instance, the toner remained on the intermediate transfer belt 482 is cleaned by a cleaning device 451 which can be turned on or off.

As mentioned above, in such a situation that the charge amount of the toner in a low humidity ambient atmosphere or the like remarkably increases, when the toner images laminated on the intermediate transfer member is transferred to the transfer material, abnormal electric discharge or the like is caused, so that the image failure easily occurs.

So far as the present inventors have studied, it can be clarified that the abnormal discharge occurs in the mechanism, which will be described hereinbelow.

Figure 13:
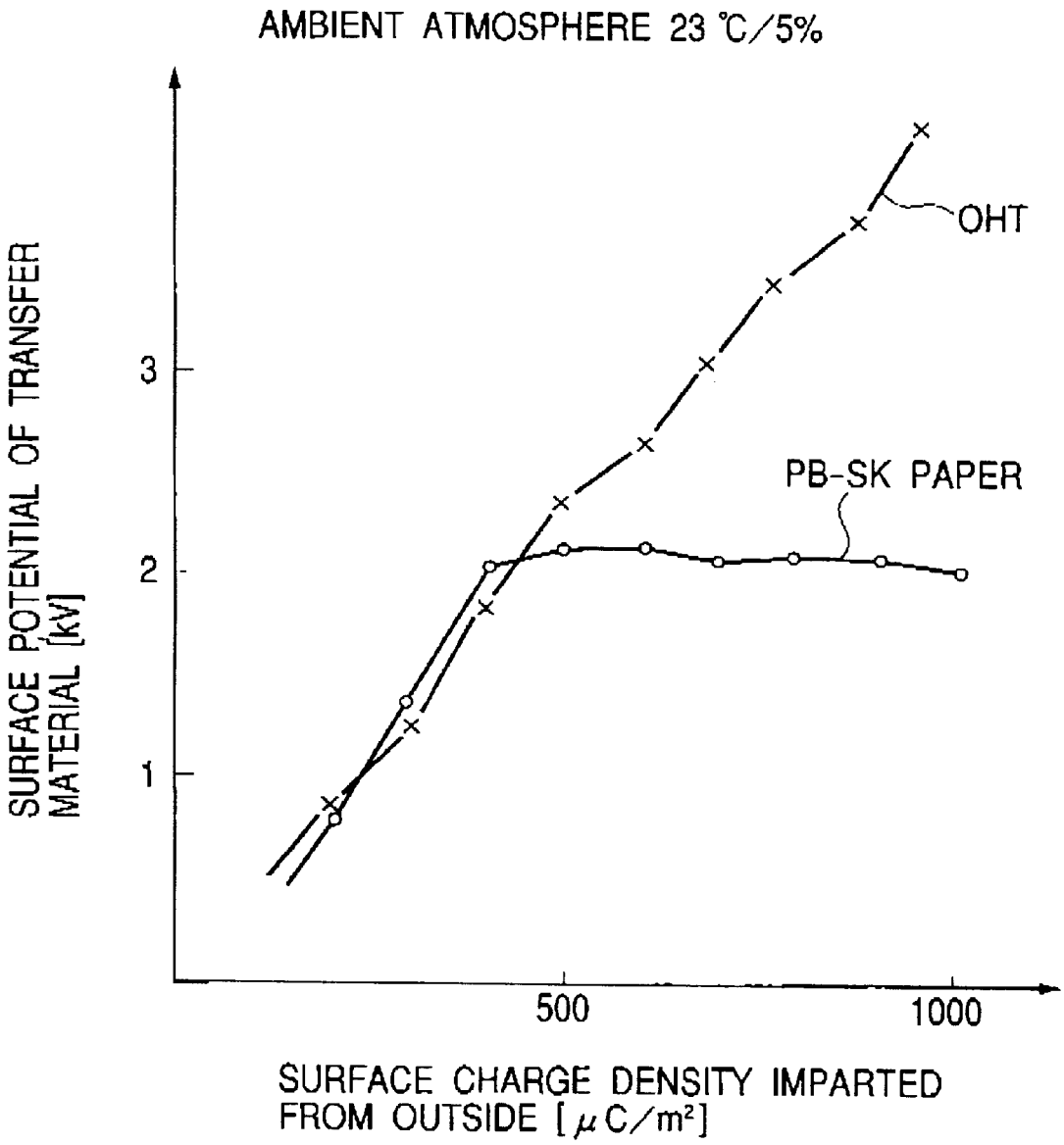
FIG. 13 is a graph showing a relation between a surface charge density imparted to the transfer material and the surface potential of the transfer material in a low humidity environment.

FIG. 13 shows a relation between the surface charge density imparted from the outside to the surface of the transfer material which has been sufficiently adapted to a low humidity ambient atmosphere of, for example, 23° C./5% and the surface potential of the transfer material.

As will be understood by referring to FIG. 13, it is clear that in the low humidity environment, namely, in such an environment that the absolute water content in the air is extremely small, the surface potential of the transfer material does not exceed a predetermined value and is saturated. The absolute water content in 23° C./5% is equal to 0.5 g/air 1 kg.

As for the saturation value of the surface potential of the transfer material sufficiently adapted to the ambient atmosphere of 23° C/5%, it differs depending on the kind of transfer material. In case of a PB-SK paper made by Nippon Paper Industries Co., Ltd. (basic weight is equal to 64 g/m$^2$), it is equal to about 2 kV. When it is expressed in a form of the retainable charge amount, it is equal to about 500 $\mu$C/m$^2$. The situation shows substantially the same tendency in both of a plus polarity and a minus polarity. Even in such a low humidity ambient atmosphere, in case of a transfer material such as OHT film which is hardly influenced by the ambient atmosphere, as shown in FIG. 13, different from the above paper, there is no case where the surface potential, namely, retainable charge amount is saturated.

Figure 14:
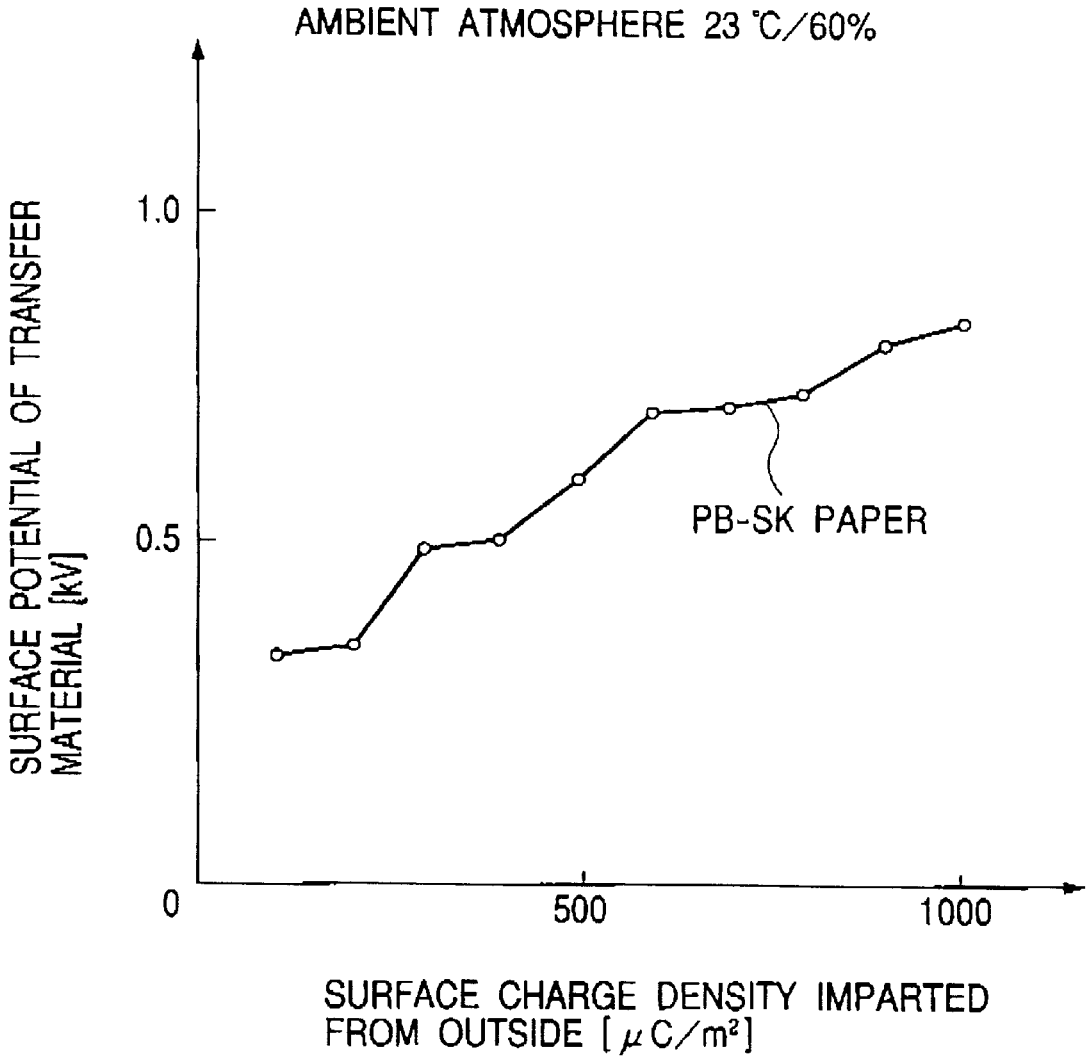
FIG. 14 is a graph showing a relation between a surface charge density imparted to the transfer material and the surface potential of the transfer material in a normal humidity environment.

FIG. 14 shows a relation between the surface charge density imparted form the outside to the surface of the transfer material which has been adapted to a normal temperature and normal humidity ambient atmosphere of, for example, 23° C./60% and the surface potential of the transfer material.

As will be understood by referring to FIG. 14, in the normal temperature and normal humidity environment, namely, in such an environment that the absolute water content in the air properly exists, it is clarified that the surface potential of the transfer material up to about the secondary transfer voltage which is used in the image formation of the normal electrophotographic process like the present invention, specifically speaking, up to about 10 kV has a proportional relation with the surface charge density imparted from the outside to the surface of the transfer material. The absolute water content in 23° C./60% is equal to 10.0 g/air 1 kg.

Figure 15:
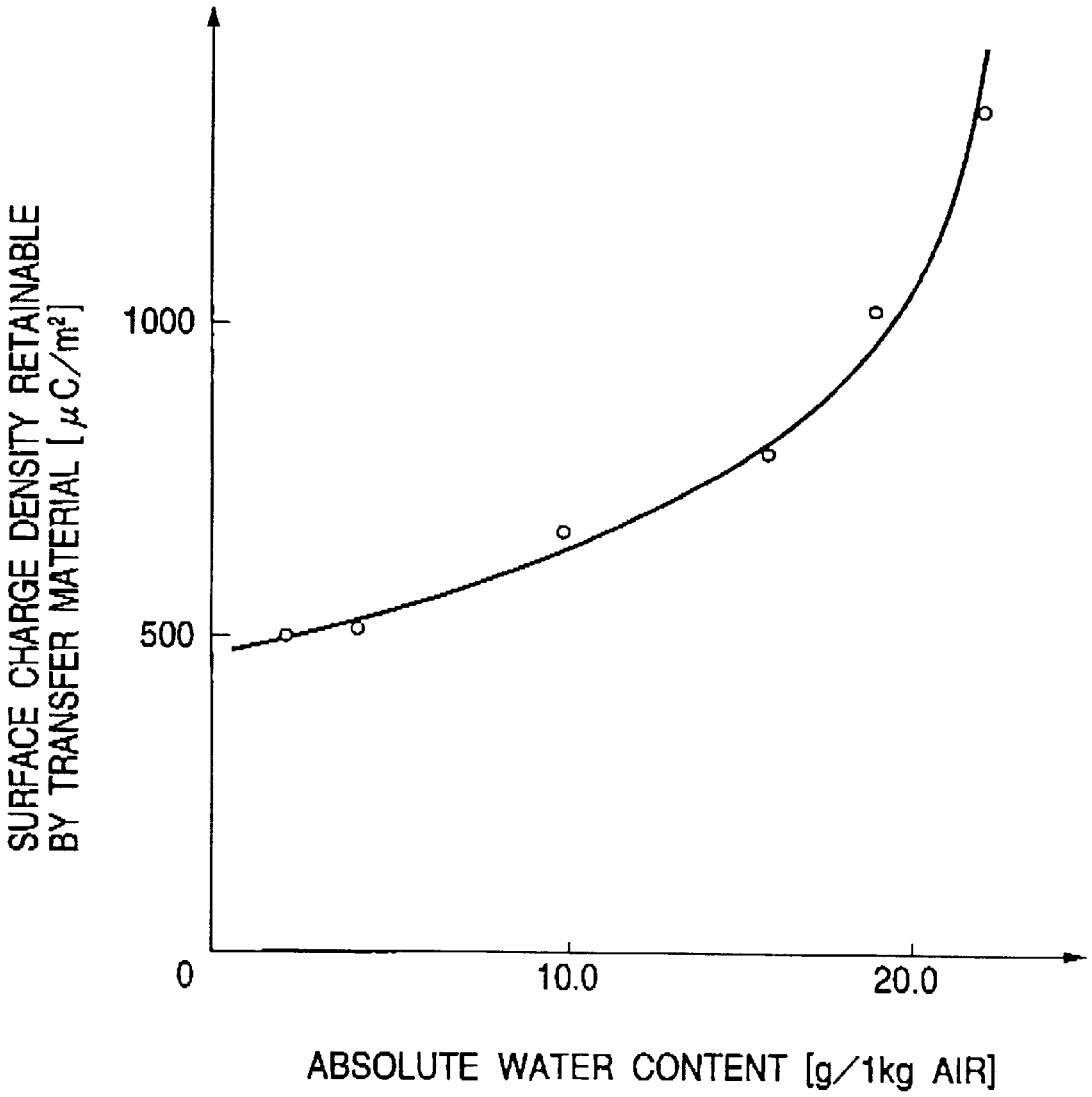
FIG. 15 is a graph showing a relation between the absolute water content of the ambient atmosphere and a surface charge density retainable by the transfer material.

FIG. 15 shows a relation between the absolute water content of the ambient atmosphere and the surface charge density retainable by the transfer material when the absolute water content is changed.

The transfer material shown in the graph is the PB-SK paper (basic weight: 64 g/m$^2$) made by Nippon Paper Industries Co., Ltd. which is the same as that shown in FIGS. 13 and 14. As will be sufficiently understood from FIG. 15, the surface charge density retainable by the transfer material and the ambient atmosphere, namely, the absolute water content have a strong correlation. It is clarified that as the absolute water content becomes smaller, the surface charge density retainable by the transfer material is also decreased.

When the mechanism of the generation of the problem regarding the image failure due to the abnormal discharge is again examined in consideration of the charge amount or the like of the toner to be used for the image formation, it is as follows.

In case of using the two-component development, the charge amount of the toner adhered on the photosensitive drum by the development is equal to about −30 $\mu$C/g in the low humidity ambient atmosphere of 23° C./5% and the toner bearing amount needed in a solid image portion (namely, the maximum image density portion) is equal to 0.01 kg/m$^2$. In case of performing the fullcolor image formation, the four color toners are superposed. Although the upper limit of the toner bearing amount per unit area at that time is determined depending on the fixing conditions or method of processing the image, it is set to a value that is about twice as much as that at the time of the monochromatic image formation in many cases. Therefore, in case of the fullcolor image formation, the maximum surface charge density by the toner is equal to −600 $\mu$C/m$^2$.

On the other hand, when the above PB-SK paper (basic weight: 64 g/m$^2$) made by Nippon Paper Industries Co., Ltd. is used as a transfer material, in the low humidity ambient atmosphere, since the absolute value of the maximum surface charge density retainable by the transfer material is equal to 500 $\mu$C/m$^2$, it is estimated that the toner charge corresponding to −100 $\mu$C/m$^2$ cannot be retained. It is thought that the abnormal discharge occurs due to the charge which cannot be retained, thereby causing the image failure.

That is, in the low humidity environment, a change in electrical characteristics of the transfer material occurs, so that the transfer material does not have a surface potential of a predetermined amount or more. In other words, the following is considered. It is impossible to retain the charge of a predetermined amount or more on the surface of the transfer material. When the toner image formed on the image bearing member is tried to be transferred onto the transfer material, the total toner charge amount increases. When a transfer electric field corresponding to it is applied to the transfer material, since the transfer material cannot retain a charge of a predetermined amount or more, the abnormal discharge easily occurs and the image failure is caused.

Similar to the embodiments 1 to 5, in the present embodiment, when the transfer material enters such a state where it is left on the above low humidity environment, the charge opposite to that at the secondary transferring time is supplied to the transfer material, namely, the charge having the same polarity as that of the toner is previously supplied to the rear surface of the transfer material, which is opposite to the side to which the toner image is transferred. Or the charge having a polarity opposite to that of the toner is previously supplied to the surface of the transfer material, on which the toner image is transferred. Consequently, the maximum value of the surface charge density retainable by the transfer material is apparently increased about twice, so that the charge amount per unit area of the toner image can be set so as not to exceed the maximum charge amount per unit area retainable by the transfer material. The occurrence of the image failure by the abnormal discharge can be prevented, and the fine image can be obtained.

According to the present invention, as mentioned above, the reverse charge roller 476 and counter roller 477 are provided in front of the secondary transferring portion where the transfer roller 472 is placed to previously supply the charge having a polarity opposite to that of the charge supplied by the transfer roller 472 at the secondary transferring time to the transfer material P before the secondary transfer. According to the present embodiment, the charge having a polarity opposite to that at the secondary transferring time (charge having the same polarity as that of the toner), namely, negative charge is supplied from the reverse charge roller 476 side to the rear surface of the transfer material P.

How amount the charge having the polarity opposite to that of the secondary transfer is previously supplied to the transfer material is similar to the embodiment 1. It is preferable in accordance with the following procedure.

When the case where the above PB-SK paper (basic weight: 64 g/m$^2$) made by Nippon Paper Industries Co., Ltd. is used as a transfer material P is shown as an example, the minimum value of the absolute value |Qp| of the maximum surface charge density retainable by the transfer material is obtained when the temperature and humidity of the ambient atmosphere where the transfer material is left are 23° C./5%. The value is equal to 500 $\mu$C/m$^2$.

In case of using a negative charge toner, the polarity of the charge to be supplied to the rear surface side of the transfer material at the secondary transferring time is positive, so that it is possible to set Qp up to +500 $\mu$C/m$^2$ in all of the environments where the apparatus is used (namely, even in the lowest humidity environment). Consequently, Qa can be set up to −500 $\mu$C/m$^2$. According to the present invention, the transfer material is reversely charged from the rear surface (surface on the opposite side of the transfer surface of the toner image) of the transfer material by the reverse charge roller 476 so as to have a surface charge density of −500 $\mu$C/m$^2$.

When it is assumed that a toner whose charge amount is equal to about −30 $\mu$C/g is transferred onto the transfer material, the maximum value of the toner bearing amount per unit area transferable to the transfer material is as follows.

$$(|500|+|-500|)/|-30|=0.0333 \text{ kg/m}^2$$

Therefore, even when the toner bearing amount per color needed to obtain an enough image density is equal to about 0.01 kg/m2, according to the present invention, the image failure due to the abnormal discharge is not caused up to 3.33 colors in all of the environments and the image can be transferred onto the transfer material. That is, in case of the image formation of the second color or more as well, an evil influence such as deterioration of the image density or change in color is not caused, so that the image failure can be prevented.

According to the present embodiment, prior to the secondary transfer, as charging the transfer material to a polarity opposite to that at the secondary transferring time, the charge of the same polarity as that of the toner is supplied by the reverse charge roller 476 to the rear surface on the opposite side of the surface of the transfer material, to which the toner image is transferred. Contrarily, the charge of the same polarity as that of the toner can also be supplied from the counter roller 477 side. Similar effects can be obtained.

Although the pair of rollers such as reverse charge roller 476 and counter roller 477 are used as reverse charging members, the present invention Is not limited to them. It is a matter of course that any means such as corona charger or brush-shaped charging member which can supply a charge to the transfer material can be used.

In the present embodiments, the case using the PB-SK paper (basic weight: 64 g/m$^2$) made by Nippon Paper Industries Co., Ltd. has been described. For the other transfer material as well, the occurrence of the image failure can be prevented by the supply of the similar reverse charge. Since the retainable surface charge density per unit area differs depending on the transfer material, it is preferable that the reverse charge amount when the transfer material is reversely charged to the value can be changed.

As a further preferred embodiment of the prevent embodiment, in the image forming apparatus main body, and near the transfer storage cassettes 429 and 430 as close as possible, a hygrothermosensor 420 which can measure a temperature and humidity is provided. The absolute water content is obtained by the arithmetic operation using the temperature and humidity in the apparatus detected by the hygrothermosensor 420. On the other hand, the relation between the absolute water content and the surface charge density retainable by the transfer material as shown in FIG. 15 has been stored in the apparatus main body (storage means such as an ROM) by the number corresponding to the kinds of transfer materials. When the image forming apparatus is used, the user previously inputs the kind of transfer material into the apparatus main body. From the input transfer material information and absolute water content of the atmosphere in the apparatus main body, the maximum surface charge density retainable of each transfer material previously stored in the apparatus main body is derived. In this manner, it is clear that the more preferable result is obtained.

Further, the surface charge density per unit area retainable by the transfer material is automatically detected by the following method and the reverse charge amount can also be determined on the basis of the detection value.

As a method of automatically detecting, independent of the normal image formation, the toner image is not transferred to the intermediate transfer belt 482, the transfer material is conveyed to the secondary transferring portion, a transfer voltage is applied to the transfer roller 472 by the constant current control, and the transfer voltage at that time is detected.

That is, the transfer voltages for a secondary transfer current value I0 and a secondary transfer current value I1 that is larger than I0 only by ΔI are measured and a difference ΔV1 between those transfer voltages is obtained by the arithmetic operation. Further, a transfer voltage for a secondary transfer current value I2 that is larger than I1 only by ΔI is measured and a difference ΔV2 between the transfer voltage at this time and one in case of the transfer current I1 is calculated. Although the differences ΔV1, ΔV2 between the transfer voltages are ordinarily held constant, when the supply charge amount to the transfer material exceeds the charge amount retainable by the transfer material, ΔVi (i=1, 2) begins to decrease. Therefore, the secondary transfer current just before ΔVi begins to decrease is obtained by the above detection flow, the maximum retainable charge amount of the transfer material is estimated from the secondary transfer current value, and the reverse charge amount at the reverse charging time is decided.

With this construction, the reverse charge amount can be automatically determined without inputting the kind of transfer material.

The above means is one means for merely automatically detecting the maximum retainable charge amount of the transfer material and any means can be used. For example, such a construction that the output of a secondary transfer high-voltage power supply is controlled to a constant current and the current at that time is detected can be used or the water content of the transfer material is detected by an infrared water content meter and the maximum retainable charge amount of the transfer material can be automatically detected from the relation between the water content and the maximum retainable charge amount of the transfer material.

While the invention has been described with reference to the structures disclosed herein, it is not confined to the details set fourth and this application is intended to cover such modifications or changes as may come within the purposes of the improvements or the scope of the following claims.

What is claimed is:

1. An image forming apparatus comprising:

image forming means for electrostatically forming a toner image onto a transfer material;

charge means for previously charging a surface of the transfer material onto which the toner image is to be formed to a polarity opposite to a normal charge polarity of toner before the toner image is formed onto the transfer material by said image forming means; and control means for controlling a charge amount per unit area to be supplied to the transfer material by said charge means in accordance with a kind of the transfer material.

2. The apparatus according to claim 1, further comprising humidity detecting means for detecting humidity, wherein said control means controls the charge amount per unit area to be supplied to the transfer material by said charge means in accordance with a detection result by said humidity detecting means.

3. The apparatus according to claim 1, further comprising hygrothermo-detecting means for detecting temperature and humidity, and wherein said control means controls the charge amount per unit area to be supplied to the transfer material by said charge means in accordance with a detection result by said hygrothermo-detecting means.

4. The apparatus according to claim 3, wherein said control means controls the charge amount per unit area to be supplied to the transfer material by said charge means in accordance with a length in a direction substantially perpendicular to a conveying direction of the transfer material.

5. The apparatus according to claim 1, further comprising discriminating means for discriminating the kind of the transfer material, wherein said control means controls the charge amount per unit area to be supplied to the transfer material by said charge means in accordance with a detection result by said discriminating means.

6. The apparatus according to claim 1, further comprising a constant current power supply that is connected to said charge means, wherein when the transfer material is charged, said control means controls a value of a current flowing through said charge means.

7. The apparatus according to any one of claim 1, wherein said image forming means includes an image bearing member for bearing the toner image, a transfer material bearing member for bearing the transfer material, and transfer means for electrostatically transferring the toner image on said image bearing member onto the transfer material borne on said transfer material bearing member.

8. The apparatus according to claim 7, wherein said charge means includes a first charge member for charging the surface of the transfer material onto which the toner image is to be transferred to the polarity opposite to the normal charge polarity of the toner and a second charge member, which is arranged opposite to said first charge member, for charging a side opposite to the surface of the transfer material onto which the toner image is to be transferred to a same polarity as the normal charge polarity of the toner, and the transfer material passes through between said first charge member and said second charge member.

9. The apparatus according to claim 8, wherein when the transfer material is charged, a voltage having the same polarity as the normal charge polarity of the toner is applied to said second charge member and said first charge member is brought into contact with the transfer material and electrically connected to a ground.

10. The apparatus according to claim 8, wherein when the transfer material is charged, said first charge member is brought into contact with the transfer material and said second charge member is come into contact with said transfer material bearing member.

11. The apparatus according to claim 7, wherein said transfer means is arranged on a side opposite to a side of said transfer material bearing member on which the transfer material is borne and, when the toner image is transferred from said image bearing member onto the transfer material borne by said transfer material bearing member, a voltage having the polarity opposite to the normal charge polarity of the toner is applied to said transfer means.

12. The apparatus according to claim 7, wherein said charge means is provided on a side of said transfer material bearing member on which the transfer material is borne and has a first charge member for charging the surface of the transfer material to which the toner image is to be transferred to the polarity opposite to the normal charge polarity of the toner and a second charge member, which is arranged opposite to said first charge member through said transfer material bearing member, for charging said transfer material bearing member to a same polarity as the normal charge polarity of the toner.

13. The apparatus according to claim 12, wherein before the toner image is transferred from said image bearing member to the transfer material borne on said transfer material bearing member, said charge means makes the transfer material electrostatically adsorb the transfer material bearing member.

14. The apparatus according to claim 7, wherein toner images of a plurality of colors are sequentially electrostatically transferred from said image bearing member to the transfer material borne on said transfer material bearing member.

15. The apparatus according to claim 1, wherein said image forming means has a plurality of image bearing members for bearing toner images of a plurality of colors, respectively, a transfer material bearing member for bearing the transfer material, and a plurality of transfer means for sequentially electrostatically transferring the toner images of the plurality of colors on said plurality of image bearing members to the transfer material borne on said transfer material bearing member.

16. The apparatus according to claim 15, wherein said charge means is provided on a side of said transfer material bearing member on which the transfer material is borne and has a first charge member for charging the surface of the transfer material to which the toner images of the plurality of colors is transferred to a polarity opposite to the normal charge polarity of the toner and a second charge member, which is arranged opposite to said first charge member through said transfer material bearing member, for charging said transfer material bearing member to a same polarity as the normal charge polarity of the toner.

17. The apparatus according to claim 16, wherein when the transfer material is charged, a voltage having the same polarity as the normal charge polarity of the toner is applied to said second charge member and said first charge member is brought into contact with the transfer material and electrically connected to the ground.

18. The apparatus according to claim 16, wherein when the transfer material is charged, said first charge member is brought into contact with the transfer material and said second charge member is brought into contact with said transfer material bearing member.

19. The apparatus according to claim 15, wherein said plurality of transfer means is provided on a side opposite to a side of said transfer material bearing member on which the transfer material is borne and, when the toner images are transferred from said plurality of image bearing members to the transfer material borne on said transfer material bearing member, a voltage having the polarity opposite to the normal charge polarity of the toner is applied to said plurality of transfer means.

20. The apparatus according to claim 15, wherein before the toner images are transferred from said plurality of image bearing members to the transfer material borne on said transfer material bearing member, said charge means makes the transfer material electrostatically adsorb said transfer material bearing member.

21. The apparatus according to claim 1, wherein said image forming means includes an image bearing member for bearing the toner image, an intermediate transfer member to which the toner image on said image bearing member is transferred, and transfer means for electrostatically transferring the toner image on said intermediate transfer member to the transfer material.

22. The apparatus according to claim 21, wherein said charge means includes a first charge member for charging the surface of the transfer material to which the toner image is to be transferred to the polarity opposite to the normal charge polarity of the toner and a second charge member, which is provided opposite to said first charge member, for charging a side opposite to the surface of the transfer material to which the toner image is to be transferred to a same polarity as the normal charge polarity of the toner, and the transfer material passes through between said first charge member and said second charge member.

23. The apparatus according to claim 22, wherein when the transfer material is charged, said first charge member and said second charge member are brought into contact with the transfer material.

24. The apparatus according to claim 21, wherein said transfer means is provided on a side of said intermediate transfer member onto which the toner image is to be transferred and, when the toner image is transferred from said intermediate transfer member to the transfer material, a voltage having the polarity opposite to the normal charge polarity of the toner is applied to said transfer means.

25. The apparatus according to claim 21, wherein said charge means conveys the transfer material to a position where the toner image is transferred from said intermediate transfer member to the transfer material.

26. The apparatus according to claim 21, wherein toner images of a plurality of colors are sequentially transferred from said image bearing member to said intermediate transfer member and said toner images of the plurality of colors on said intermediate transfer member are transferred to the transfer material by said transfer means.

27. The apparatus according to claim 1, wherein said image forming means includes a plurality of image bearing members for bearing toner images of a plurality of colors, respectively, an intermediate transfer member to which the toner images on said plurality of image bearing members are sequentially transferred, and transfer means for electrostatically transferring the toner images of the plurality of colors on said intermediate transfer member to the transfer material.

28. The apparatus according to claim 27, wherein said charge means includes a first charge member for charging the surface of the transfer material to which the toner images of the plurality of colors is to be transferred to the polarity opposite to the normal charge polarity of the toner and a second charge member, which is provided opposite to said first charge member, for charging a side opposite to the surface of the transfer material to which the toner is to be transferred to the same polarity as the normal charge polarity of the toner, and the transfer material passes through between said first charge member and said second charge member.

29. The apparatus according to claim 28, wherein when the transfer material is charged, said first charge member and said second charge member are come into contact with the transfer material.

30. The apparatus according to claim 27, wherein said transfer means is provided on a side of said intermediate transfer member onto which the toner images of the plurality of colors is to be transferred and, when the toner images of the plurality of colors is transferred from said intermediate transfer member to the transfer material, a voltage having the polarity opposite to the normal charge polarity of the toner is applied to said transfer means.

31. The apparatus according to claim 27, wherein said charge means conveys the transfer material to a position where the toner images are transferred from said intermediate transfer member to the transfer material.

32. The apparatus according to claim 1, wherein said image forming means includes an image bearing member for bearing the toner image and transfer means for electrostatically transferring the toner image on said image bearing member to the transfer material.

33. The apparatus according to claim 32, wherein said charge means includes a first charge member for charging the surface of the transfer material to which the toner image is to be transferred to the polarity opposite to the normal charge polarity of the toner and a second charge member, which is provided opposite to said first charge member, for charging a side opposite to the surface of the transfer material to which the toner image is to be transferred to a same polarity as the normal charge polarity of the toner, and the transfer material passes through between said first charge member and said second charge member.

34. The apparatus according to claim 33, wherein when the transfer material is charged, said first charge member and said second charge member are come into contact with the transfer material.

35. The apparatus according to claim 32, wherein said transfer means is provided on a side of said image bearing member on which the toner image is to be borne and, when the toner image is transferred from said image bearing member to the transfer material, a voltage having the polarity opposite to the normal charge polarity of the toner is applied to said transfer means.

36. The apparatus according to claim 32, wherein said charge means conveys the transfer material to a position where the toner image is transferred from said image bearing member to the transfer material.

37. An image forming apparatus comprising:

image forming means for electrostatically forming a toner image onto a transfer material;

charge means for previously charging a surface of the transfer material onto which the toner image is formed to a polarity opposite to a normal charge polarity of toner before the toner image is formed onto the transfer material by said image forming means; and control means for controlling a charge amount per unit area to be supplied to the transfer material by said charge means in accordance with a length in a direction substantially perpendicular to a conveying direction of the transfer material.

38. The apparatus according to claim 37, further comprising humidity detecting means for detecting humidity, wherein said control means controls the charge amount per unit area to be supplied to the transfer material by said charge means in accordance with a detection result by said humidity detecting means.

39. The apparatus according claim 37, further comprising hygrothermo-detecting means for detecting temperature and humidity, wherein said control means controls the charge amount per unit area to be supplied to the transfer material by said charge means in accordance with a detection result by said hygrothermo-detecting means.

40. The apparatus according to claim 37, further comprising discriminating means for discriminating a kind of the transfer material, wherein said control means controls the charge amount per unit area to be supplied to the transfer material by said charge means in accordance with a detection result by said discriminating means.

41. The apparatus according to claim 37, further comprising a constant current power supply that is connected to said charge means, wherein when the transfer material is charged, said control means controls a value of a current flowing through said charge means.

42. The apparatus according to claim 37, wherein said image forming means includes an image bearing member for bearing the toner image, a transfer material bearing member for bearing the transfer material, and transfer means for electrostatically transferring the toner image on said image bearing member onto the transfer material borne on said transfer material bearing member.

43. The apparatus according to claim 42, wherein said charge means includes a first charge member for charging the surface of the transfer material onto which the toner image is to be transferred to the polarity opposite to the normal charge polarity of the toner and a second charge member, which is arranged opposite to said first charge member, for charging a side opposite to the surface of the transfer material onto which the toner image is to be transferred to a same polarity as the normal charge polarity of the toner, and the transfer material passes through between said first charge member and said second charge member.

44. The apparatus according to claim 43, wherein when the transfer material is charged, a voltage having the same polarity as the normal charge polarity of the toner is applied to said second charge member and said first charge member is brought into contact with the transfer material and electrically connected to a ground.

45. The apparatus according to claim 43, wherein when the transfer material is charged, said first charge member is brought into contact with the transfer material and said second charge member is brought into contact with said transfer material bearing member.

46. The apparatus according to claim 42, wherein said transfer means is arranged on a side opposite to a side of said transfer material bearing member on which the transfer material is borne and, when the toner image is transferred from said image bearing member onto the transfer material borne by said transfer material bearing member, a voltage having the polarity opposite to the normal charge polarity of the toner is applied to said transfer means.

47. The apparatus according to claim 42, wherein said charge means is provided on a side of said transfer material bearing member on which the transfer material is borne and has a first charge member for charging the surface of the transfer material to which the toner image is to be transferred to the polarity opposite to the normal charge polarity of the toner and a second charge member, which is arranged opposite to said first charge member through said transfer material bearing member, for charging said transfer material bearing member to a same polarity as the normal charge polarity of the toner.

48. The apparatus according to claim 47, wherein before the toner image is transferred from said image bearing member to the transfer material borne on said transfer material bearing member, said charge means makes the transfer material electrostatically adsorb said transfer material bearing member.

49. The apparatus according to claim 42, wherein toner images of a plurality of colors are sequentially electrostatically transferred from said image bearing member to the transfer material borne on said transfer material bearing member.

50. The apparatus according to claim 37, wherein said image forming means has a plurality of image bearing members for bearing toner images of a plurality of colors, respectively, a transfer material bearing member for bearing the transfer material, and a plurality of transfer means for sequentially electrostatically transferring the toner images of the plurality of colors on said plurality of image bearing members to the transfer material borne on said transfer material bearing member.

51. The apparatus according to claim 50, wherein said charge means is provided on a side of said transfer material bearing member on which the transfer material is borne and has a first charge member for charging the surface of the transfer material to which the toner images of the plurality of colors is transferred to a polarity opposite to the normal charge polarity of the toner and a second charge member, which is arranged opposite to said first charge member through said transfer material bearing member, for charging said transfer material bearing member to the same polarity as the normal charge polarity of the toner.

52. The apparatus according to claim 51, wherein when the transfer material is charged, a voltage having the same polarity as the normal charge polarity of the toner is applied to said second charge member and said first charge member is brought into contact with the transfer material and electrically connected to the ground.

53. The apparatus according to claim 51, wherein when the transfer material is charged, said first charge member is brought into contact with the transfer material and said second charge member is brought into contact with said transfer material bearing member.

54. The apparatus according to claim 50, wherein said transfer means is provided on a side opposite to a side of said transfer material bearing member on which the transfer material is borne and, when the toner images are transferred from said plurality of image bearing members to the transfer material borne on said transfer material bearing member, a voltage having the polarity opposite to the normal charge polarity of the toner is applied to said plurality of transfer means.

55. The apparatus according to claim 50, wherein before the toner images are transferred from said plurality of image bearing members to the transfer material borne on said transfer material bearing member, said charge means makes the transfer material electrostatically adsorb to said transfer material bearing member.

56. The apparatus according to claim 37, wherein said image forming means includes an image bearing member for bearing the toner image, an intermediate transfer member to which the toner image on said image bearing member is transferred, and transfer means for electrostatically transferring the toner image on said intermediate transfer member to the transfer material.

57. The apparatus according to claim 56, wherein said charge means includes a first charge member for charging the surface of the transfer material to which the toner image is to be transferred to the polarity opposite to the normal charge polarity of the toner and a second charge member, which is provided opposite to said first charge member, for charging a side opposite to the surface of the transfer material to which the toner image is to be transferred to a same polarity as the normal charge polarity of the toner, and the transfer material passes through between said first charge member and said second charge member.

58. The apparatus according to claim 57, wherein when the transfer material is charged, said first charge member and said second charge member are brought into contact with the transfer material.

59. The apparatus according to claim 56, wherein said transfer means is provided on a side of said intermediate transfer member onto which the toner image is to be transferred and, when the toner image is transferred from said intermediate transfer member to the transfer material, a voltage having the polarity opposite to the normal charge polarity of the toner is applied to said transfer means.

60. The apparatus according to claim 56, wherein said charge means conveys the transfer material to a position where the toner image is transferred from said intermediate transfer member to the transfer material.

61. The apparatus according to claim 56, wherein toner images of a plurality of colors are sequentially transferred from said image bearing member to said intermediate transfer member and the toner images of the plurality of colors on said intermediate transfer member are transferred to the transfer material by said transfer means.

62. The apparatus according to claim 37, wherein said image forming means includes a plurality of image bearing members for bearing toner images of a plurality of colors, respectively, an intermediate transfer member to which the toner images on said plurality of image bearing members are sequentially transferred, and transfer means for electrostatically transferring the toner images of the plurality of colors on said intermediate transfer member to the transfer material.

63. The apparatus according to claim 62, wherein said charge means includes a first charge member for charging the surface of the transfer material to which the toner images of the plurality of colors is to be transferred to the polarity opposite to the normal charge polarity of the toner and a second charge member, which is provided opposite to said first charge member, for charging a side opposite to the surface of the transfer material to which the toner images of the plurality of colors is transferred to the same polarity as the normal charge polarity of the toner, and the transfer material passes through between said first charge member and said second charge member.

64. The apparatus according to claim 63, wherein when the transfer material is charged, said first charge member and said second charge member are brought into contact with the transfer material.

65. The apparatus according to claim 62, wherein said transfer means is provided on a side of said intermediate transfer member onto which the toner images of the plurality of colors is to be transferred and, when the toner images of the plurality of colors is transferred from said intermediate transfer member to the transfer material, a voltage having the polarity opposite to the normal charge polarity of the toner is applied to said transfer means.

66. The apparatus according to claim 62, wherein said charge means conveys the transfer material to a position where the toner images of the plurality of colors is transferred from said intermediate transfer member to the transfer material.

67. The apparatus according to claim 37, wherein said image forming means includes an image bearing member for bearing the toner image and transfer means for electrostatically transferring the toner image on said image bearing member to the transfer material.

68. The apparatus according to claim 67, wherein said charge means includes a first charge member for charging the surface of the transfer material to which the toner image is to be transferred to the polarity opposite to the normal charge polarity of the toner and a second charge member, which is provided opposite to said first charge member, for charging a side opposite to the surface of the transfer material to which the toner image is to be transferred to a same polarity as the normal charge polarity of the toner, and the transfer material passes through between said first charge member and said second charge member.

69. The apparatus according to claim 68, wherein when the transfer material is charged, said first charge member and said second charge member are come into contact with the transfer material.

70. The apparatus according to claim 67, wherein said transfer means is provided on a side of said image bearing member on which the toner image is to be borne and, when the toner image is transferred from said image bearing member to the transfer material, a voltage having the polarity opposite to the normal charge polarity of the toner is applied to said transfer means.

71. The apparatus according to claim 67, wherein said charge means conveys the transfer material to a position where the toner image is transferred from said image bearing member to the transfer material.

72. An image forming apparatus comprising:

an image bearing member for bearing a toner image;

an intermediate transfer member to which the toner image on said image bearing member is transferred; and charge means for charging in advance a surface of the transfer material to which the toner image is to be transferred to a polarity opposite to a normal charge polarity of toner before the toner image on said intermediate transfer member is electrostatically transferred to the transfer material.

73. The apparatus according to claim 72, further comprising control means for controlling a voltage to be applied to said charge means in accordance with a kind of the transfer material.

74. The apparatus according to claim 72, further comprising control means for controlling a charge amount per unit area to be supplied to the transfer material by said charge means in accordance with a kind of the transfer material.

75. The apparatus according to claim 72, further comprising control means for controlling a voltage to be applied to said charge means in accordance with a length in a direction substantially perpendicular to a conveying direction of the transfer material.

76. The apparatus according to claim 72, further comprising control means for controlling a charge amount per unit area to be supplied to the transfer material by said charge means in accordance with a length in a direction substantially perpendicular to a conveying direction of the transfer material.

77. The apparatus according to claim 72, further comprising humidity detecting means for detecting humidity, and control means for controlling a voltage to be applied to said charge means in accordance with a detection result by said humidity detecting means.

78. The apparatus according to claim 72, further comprising hygrothermo-detecting means for detecting temperature and humidity, and control means for controlling a voltage to be applied to said charge means in accordance with a detection result by said hygrothermo-detecting means.

79. The apparatus according to claim 72, wherein control means controls a voltage to be applied to said charge means in accordance with a length in a direction substantially perpendicular to a conveying direction of the transfer material.

80. The apparatus according to claim 72, further comprising discriminating means for discriminating a kind of the transfer material, wherein control means controls the voltage to be applied to said charge means in accordance with a detection result by said discriminating means.

81. The apparatus according to claim 72, further comprising a constant current power supply that is connected to said charge means, wherein when the transfer material is charged, control means controls a value of a current flowing through said charge means.

82. The apparatus according to claim 72, further comprising transfer means for electrostatically transferring the toner image on said intermediate transfer member to the transfer material.

83. The apparatus according to claim 82, wherein said transfer means is provided on a side of said intermediate transfer member to which the toner image is to be transferred and, when the toner image on said intermediate transfer member is transferred to the transfer material, a voltage having the polarity opposite to the normal charge polarity of the toner is applied to said transfer means.

84. The apparatus according to claim 72, wherein toner images of a plurality of colors are sequentially transferred from said image bearing member to said intermediate transfer member and the toner images of the plurality of colors on said intermediate transfer member are transferred to the transfer material.

* * * * *

UNITED STATES PATENT AND TRADEMARK OFFICE

CERTIFICATE OF CORRECTION

PATENT NO. : 6,253,041 B1
DATED : June 26, 2001
INVENTOR(S) : Takeshi Tomizawa et al.

It is certified that error appears in the above-identified patent and that said Letters Patent is hereby corrected as shown below:

Column 3,
Line 15, "5" should be deleted.

Column 5,
Line 23, "B" should read -- 8 --.

Column 6,
Line 48, "was" should read -- were --.

Column 8,
Line 54, "causes" should read -- cause --.
Line 66, "s;" should read -- s: --.

Column 10,
Line 12, "Oa" should read -- Qa --.

Column 11,
Line 9, "basis" should read -- basic --.
Line 45, "need" should read -- needs --.

Column 14,
Line 23, "390=1.6" should read -- 390≃1.6 --.
Line 43, "(Qp" should read -- (Cp --.

Column 18,
Line 35, "9B;" should read -- 9B: --.

Column 19,
Line 48, "increase" should read -- increases. --.

Column 22,
Line 29, "is" should read -- are --.
Line 63, "form" should read -- from --.

Column 24,
Line 66, "kg/m2," should read -- $kg/m^2$, --.

UNITED STATES PATENT AND TRADEMARK OFFICE

CERTIFICATE OF CORRECTION

PATENT NO. : 6,253,041 B1
DATED : June 26, 2001
INVENTOR(S) : Takeshi Tomizawa et al.

It is certified that error appears in the above-identified patent and that said Letters Patent is hereby corrected as shown below:

Column 25,
Line 31, "prevent" should read -- present --.

Column 27,
Line 8, "any one of" should be deleted.
Line 36, "come" should read -- brought --.

Column 28,
Line 14, "is" should read -- are --.

Column 29,
Lines 30, 46 and 47, "is" should read -- are --.
Line 41, "come" should read -- brought --.

Column 30,
Line 5, "come" should read -- brought --.
Line 38, "according" should read -- according to --.

Column 31,
Line 62, "is" should read -- are --.

Column 33,
Lines 27, 28 and 34, "is" should read -- are --.
Line 55, "come" should read -- brought --.

Signed and Sealed this

Twenty-third Day of April, 2002

*Attest:*

*Attesting Officer*

JAMES E. ROGAN
*Director of the United States Patent and Trademark Office*